US007492340B2

(12) United States Patent
Isami et al.

(10) Patent No.: US 7,492,340 B2
(45) **Date of Patent: *Feb. 17, 2009**

(54) LIQUID CRYSTAL DISPLAY DEVICE HAVING STABILIZED DRIVE CIRCUIT

(75) Inventors: Hironobu Isami, Chiba (JP); Iwao Takemoto, Mobara (JP); Katsumi Matsumoto, Mobara (JP)

(73) Assignees: Hitachi, Ltd., Tokyo (JP); Hitachi Device Engineering Co., Ltd., Mobara-shi (JP)

( * ) Notice: Subject to any disclaimer, the term of this patent is extended or adjusted under 35 U.S.C. 154(b) by 505 days.

This patent is subject to a terminal disclaimer.

(21) Appl. No.: 11/385,741

(22) Filed: Mar. 22, 2006

(65) Prior Publication Data

US 2006/0164357 A1 Jul. 27, 2006

Related U.S. Application Data

(63) Continuation of application No. 10/389,801, filed on Mar. 18, 2003, now Pat. No. 7,042,430.

(30) Foreign Application Priority Data

Mar. 18, 2002 (JP) ..... 2002-073494

(51) Int. Cl.
*G09G 3/36* (2006.01)

(52) U.S. Cl. ..... 345/89; 345/87; 345/98; 345/99; 345/100; 345/204; 345/205; 345/206; 345/690

(58) Field of Classification Search ..... 345/87, 345/89, 98–100, 204–206, 690
See application file for complete search history.

(56) References Cited

U.S. PATENT DOCUMENTS

| | | | | |
|---|---|---|---|---|
| 3,786,362 | A | 1/1974 | Marsh et al. | |
| 5,337,070 | A | 8/1994 | Kitajima et al. | |
| 5,363,118 | A | 11/1994 | Okumura | |
| 5,929,847 | A | 7/1999 | Yanagi et al. | |
| 6,160,533 | A * | 12/2000 | Tamai et al. | 345/89 |
| 6,433,768 | B1 | 8/2002 | Miyazawa et al. | |
| 6,791,521 | B2 | 9/2004 | Isami et al. | |

FOREIGN PATENT DOCUMENTS

| | | |
|---|---|---|
| JP | 5-100635 | 4/1993 |
| JP | 09-073283 | 3/1997 |
| JP | 10-105128 | 4/1998 |
| JP | 2002-194330 | 7/2000 |

* cited by examiner

*Primary Examiner*—Sumati Lefkowitz
*Assistant Examiner*—Alexander S. Beck
(74) *Attorney, Agent, or Firm*—Antonelli, Terry, Stout & Kraus, LLP.

(57) ABSTRACT

A liquid crystal display device has a liquid crystal display panel and a drive circuit for supplying gray scale voltages to pixels in the liquid crystal display panel. The drive circuit selects intended gray scale voltage levels from a gray scale voltage varying with time periodically by determining a timing corresponding to the intended voltage level of the gray scale voltage based upon a display data signal and time control signals supplied to the drive circuit. A stabilizer circuit is provided to a gray scale voltage line for supplying the gray scale voltage.

3 Claims, 26 Drawing Sheets

FIG. 4A

| PROCESSING-RESULT TRANSMITTING CKT | CASE 1 | CASE 2 | CASE 3 | CASE 4 | CASE 5 | CASE 6 | CASE 7 | CASE 8 |
|---|---|---|---|---|---|---|---|---|
| 333 | — | — | — | — | SW | SW | SW | SW |
| 332 | — | — | SW | SW | — | — | SW | SW |
| 331 | — | SW | — | SW | — | SW | — | SW |

LIQUID CRYSTAL DISPLAY DEVICE HAVING STABILIZED DRIVE CIRCUIT

CROSS REFERENCE TO RELATED APPLICATION

This application is a continuation of U.S. application Ser. No. 10/389,801, filed Mar. 18, 2003, now U.S. Pat. No. 7,042,430, the contents of which are incorporated herein by reference.

BACKGROUND OF THE INVENTION

The present invention relates to a liquid crystal display device, and in particular, to a technique useful for a driver-circuit-integrated liquid crystal display device having a display section and a drive circuit therefor fabricated on the same substrate.

Recently liquid crystal display devices have been widely used in equipment ranging from small display devices to display terminals for office automation equipment and the like. Basically, a liquid crystal display device includes a liquid crystal panel (also called a liquid display element or a liquid crystal cell) which has a layer of liquid crystal composition (a liquid crystal layer) sandwiched between a pair of insulating substrates, at least one of which is made of a transparent substrate (for example, a glass plate or a plastic substrate).

This liquid crystal panel produces an image by selectively applying voltages to various pixel-forming electrodes, and thereby changing orientation of liquid crystal molecules of the liquid crystal composition in desired pixels. Among the liquid crystal panels, a type is known in which pixels are arranged in a matrix configuration to form a display section. Liquid crystal panels having pixels arranged in a matrix can be roughly classified into two types, a simple matrix type and an active matrix type. The simple matrix type forms pixels at intersections of two strip electrodes intersecting each other which are disposed respectively on a pair of insulating substrates. On the other hand, the active matrix type has pixel electrodes and active elements (for example, thin film transistors) for pixel selection in respective pixels. By selecting desired ones from among the active elements, the active matrix type forms an image by pixel electrodes coupled to the selected active elements and a reference electrode facing the selected pixel electrodes.

The active matrix type liquid crystal display device are widely used as display devices for notebook personal computers and the like. In general, the active matrix type liquid crystal display devices employ a so-called vertical electric field type in which an electric field is applied between two electrodes disposed on the two substrates, respectively, so as to change orientation of liquid crystal molecules of the liquid crystal layer sandwiched between the two electrodes. Also, the liquid crystal display devices of the so-called horizontal electric field type (also called IPS (In-Plane Switching) type) have been put to practical use. The so-called horizontal electric field type applies electric fields in the liquid crystal layer approximately in parallel with major surfaces of the two substrates.

On the other hand, liquid crystal projectors have been put to practical use which employ liquid crystal display devices. The liquid crystal projectors irradiate illuminating light from a light source onto their liquid crystal panels and project images on the liquid crystal panels onto a screen. The liquid crystal projectors employ two types of liquid crystal panels, the reflective and transmissive types. In the reflective type the liquid crystal panel, by making pixel electrodes light-reflective, and disposing structures such as wiring lines below the pixel electrodes, the approximately entire area of the display section can be used as a usable reflective surface, and therefore the reflective type is more advantageous than the transmissive type for realization of small-sized, high-definition and high-luminance liquid crystal panels.

In addition, the driver-circuit-integrated type liquid crystal display device is used as the active-matrix type liquid crystal display device for the liquid crystal projector, because the driver-circuit-integrated type liquid crystal display device has a driver circuit for driving pixel electrodes disposed also on a substrate on which the pixel electrodes are, and is capable of realizing a small-sized and high-definition liquid crystal display device.

Furthermore, among the driver-circuit-integrated type liquid crystal display devices, a reflective type liquid crystal display device (hereinafter sometimes called a Liquid Crystal on Silicon or an LCOS) is known in which has pixel electrodes and a driver circuit formed on a semiconductor substrate, but not on an insulating substrate.

In the driver-circuit-integrated type liquid crystal display devices, in a case where a D/A conversion (hereinafter sometimes called a digital-analog conversion) is employed which selects a gray scale voltage level to be supplied to a pixel electrode based upon display data in digital form, a problem arises in that, as the number of gray scale levels to be displayed is increased, the number of bits of display data is increased, and consequently, the size of circuit structures is excessively increased.

However, there is a tendency for output signals from video equipment to be provided in digital form, instead of analog form, and therefore, in the driver-circuit-integrated type liquid crystal display devices also, a driving method is desired in which the liquid crystal display device receives digital signals, and converts the digital signals into video signal voltages exhibiting plural gray scale voltage by using a drive circuit fabricated on the liquid crystal display panel.

As a method of producing a plural-gray-scale display in the driver-circuit-integrated type liquid crystal display device supplied with digital signal inputs, Japanese Patent Application Laid-Open No. 2,000-194,330 discloses a D/A conversion method of performing a D/A conversion by using a selector circuit configured to select a desired voltage level from a voltage varying in a staircase fashion.

SUMMARY OF THE INVENTION

As explained above, the driver-circuit-integrated type liquid crystal display device is required to reduce the size of its drive circuit for reducing the size of the liquid crystal display device, increasing the degree of display definition, or increasing the number of gray scale levels. Further, in a case where the so-called digital-analog conversion method is used which selects a desired gray scale voltage level based upon digital display data, in supplying the gray scale voltage to a pixel electrode, a problem becomes pronounced in that, as the number of gray scale levels to be displayed is increased, the number of bits of display data is increased, and consequently, the size of circuit structures is excessively increased.

In the case of the D/A conversion method disclosed in Japanese Patent Application Laid-Open No. 2,000-194,330, the present inventors found that distortions occur in a gray scale voltage varying in a staircase fashion, when the number of pixels is increased for increasing display definition, and consequently, the size of the circuit structures and loads are increased.

In an embodiment of the present invention, a liquid crystal display panel has a display section formed with pixels and a drive circuit for driving the pixels fabricated on the same substrate, employs a digital-analog conversion method of selecting a gray scale voltage level from a gray scale voltage varying in a staircase fashion for supplying the selected gray scale voltage to a pixel electrode, and employs a buffer circuit coupled to a signal line supplying the gray scale voltage varying in a staircase fashion.

In accordance with an embodiment of the present invention, there is provided a liquid crystal display device comprising: a liquid crystal display panel including a first substrate, a second substrate, a liquid crystal composition sandwiched between said first substrate and said second substrate, a plurality of pixels arranged in a matrix configuration on said first substrate, a plurality of video signal lines for supplying video signal voltages to said plurality of pixels; and a drive circuit for supplying video signal voltages to said plurality of video signal lines, wherein said drive circuit includes a selector circuit which receives display data signals, a gray scale voltage varying with time periodically, and time control signals varying in synchronism with said gray scale voltage, and selects a voltage level of said gray scale voltage in accordance with said display data signals in cooperation with said time control signals; said selector circuit has a plurality of display data signal lines coupled thereto for receiving said display data signals, and is composed of a plurality of series combinations of a plurality of processing circuits each disposed between two adjacent ones of said plurality of display data signal lines, and each of said plurality of processing circuits is composed of a parallel combination of a display data switching element and a time signal switching element, with a control terminal of said display data switching element being supplied with a corresponding one of said display data signals, and with a control terminal of said time signal switching element being supplied with a corresponding one of said time control signals; and a stabilizer circuit is provided to a gray scale voltage line for supplying said gray scale voltage such that a change in voltage or current is suppressed under varying loads on said gray scale voltage line.

In another embodiment of the present invention, there is provided a liquid crystal display device comprising: a liquid crystal display panel including a first substrate, a second substrate, a liquid crystal composition sandwiched between said first substrate and said second substrate, a plurality of pixels arranged in a matrix configuration on said first substrate, a plurality of video signal lines for supplying video signal voltages to said plurality of pixels; and a drive circuit for supplying video signal voltages to said plurality of video signal lines, wherein said drive circuit includes a selector circuit which receives display data signals, a gray scale voltage varying with time periodically, and time control signals varying in synchronism with said gray scale voltage, and selects a voltage level of said gray scale voltage in accordance with said display data signals in cooperation with said time control signals; said selector circuit has N display data signal lines coupled thereto for receiving said display data signals, and has N time control signal lines coupled thereto for receiving said time control signals, and is composed of a plurality of decoder circuit columns each composed of a plurality of processing circuits connected in series and each disposed between two adjacent ones of said plurality of display data signal lines, each of said plurality of processing circuits is composed of a parallel combination of a display data switching element and a time signal switching element, with a control terminal of said display data switching element being coupled to a corresponding one of said N display data signal lines, and with a control terminal of said time signal switching element being coupled to a corresponding one of said N time control signal lines, said N display data make $2^N$ different combinations by selecting a number of from zero to N of said display data switching elements, assigning said selected number of said display data switching elements to be turned OFF and turning ON the remainder of said display data switching elements in each of said plurality of decoder circuit columns, each of said $2^N$ different combinations being uniquely in synchronism with one level of said gray scale voltage, said time control signals uniquely determine one level of said gray scale voltage by turning ON a time control signal switching element constituting said parallel combination with said turned-OFF display data switching element, and a stabilizer circuit is provided to a gray scale voltage line for supplying said gray scale voltage such that a change in voltage or current is suppressed under varying loads on said gray scale voltage line.

BRIEF DESCRIPTION OF THE DRAWINGS

In the accompanying drawings, in which like reference numerals designate similar components throughout the figures, and in which:

FIG. 4A is a table explaining switch circuit combinations formed of processing result transmitting circuits;

DETAILED DESCRIPTION OF THE PREFERRED EMBODIMENTS

Hereinafter, the preferred embodiments of the present invention will be described in detail by reference to the drawings. In all figures for explaining the preferred embodiments of the present invention, the same numerals or characters designate functionally similar parts or portions, and repetition of their explanations is omitted.

Figure 1:
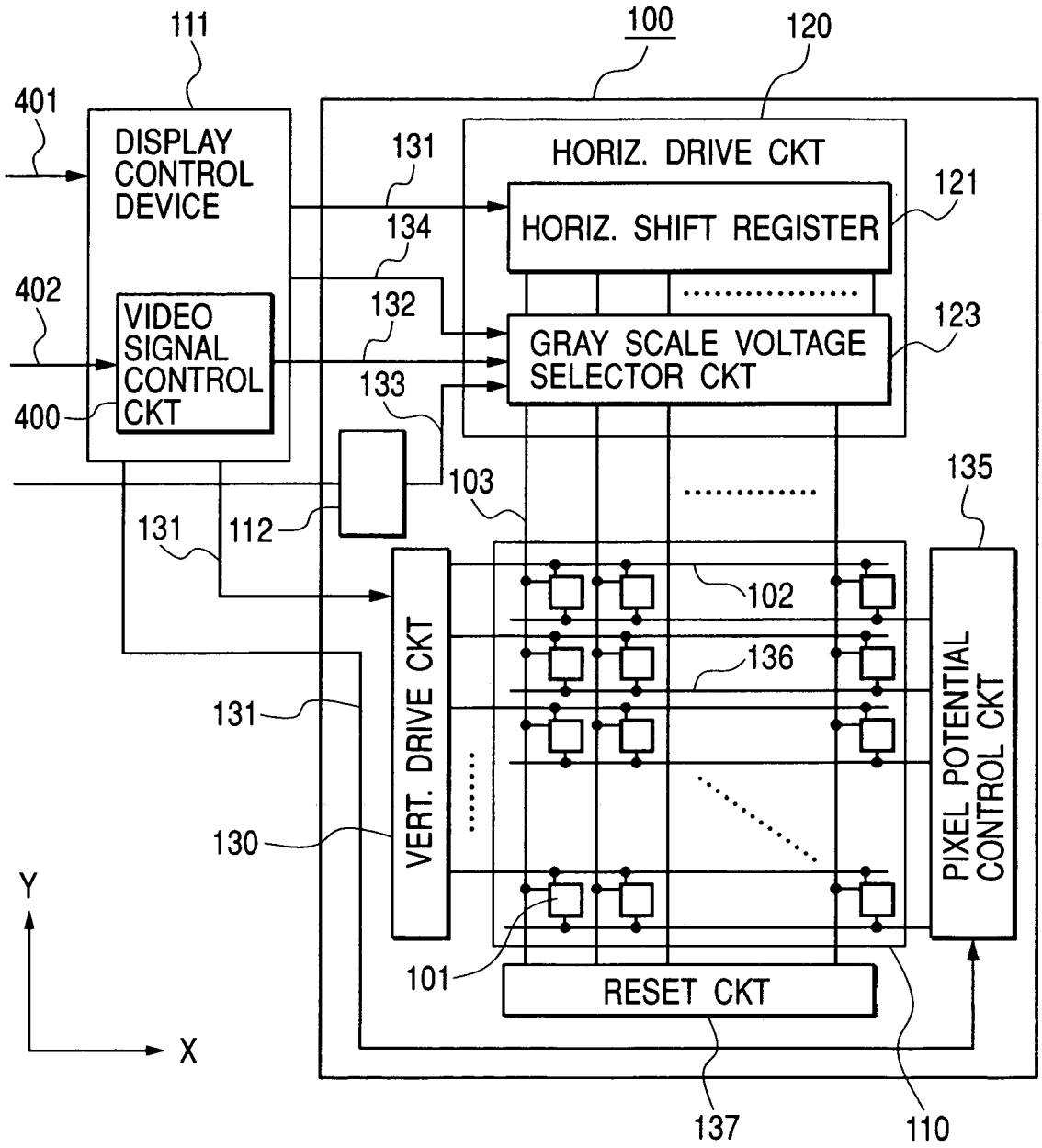
FIG. 1 is a block diagram illustrating a schematic overall configuration of an embodiment of the liquid crystal display device in accordance with the present invention.

FIG. 1 is a block diagram showing a schematic configuration of a crystal display device according to a preferred embodiment of the present invention.

The crystal display device according to the preferred embodiment of the present invention includes a liquid crystal panel (liquid crystal display element) 100 and a display control device 111. The liquid crystal panel 100 includes a display section 110 formed with pixels 101 arranged in a matrix configuration, a horizontal drive circuit (video signal line drive circuit) 120, a vertical drive circuit (scanning line drive circuit) 130, a pixel-potential control circuit 135, and a reset circuit 137. The display section 110, the horizontal drive circuit 120, the vertical drive circuit 130, the pixel-potential control circuit 135, and the reset circuit 137 are disposed on the same substrate. Each of the pixels 101 is provided with a pixel electrode, a counter electrode and a liquid layer (not shown) sandwiched between the pixel electrode and the counter electrode. Displaying is achieved by applying a voltage between the pixel electrode and the counter electrode to change the orientation and others of liquid crystal molecules, and thereby changing properties of the liquid crystal layer relating to light. The present invention can be effectively applied to a liquid crystal display device having the pixel-potential control circuit 135, but are not limited thereto. The present invention can be effectively applied to a liquid crystal display device having the reset circuit 137, but are not limited thereto.

The display control device 111 is connected to an externally-supplied-control-signal line 401 from external equipment (a personal computer, for example). The display control device 111 supplies to control signal lines 131, signals for controlling the horizontal drive circuit 120, the vertical drive circuit 130, and the pixel-potential control circuit 135, by using control signals such as clock signals, a display timing signal, a horizontal sync signal, and a vertical sync signal transmitted from an external source via the externally-supplied-control-signal line 401.

Further, the display control device 111 includes a video signal control circuit 400 which is connected to a display signal line 402 for receiving display signals from external equipment. The display signals are supplied in various signal forms depending upon the external equipment. Therefore, the video signal control circuit 400 creates video signals to be supplied to the liquid crystal panel 100 from the display signals. The video signals are transmitted to the liquid crystal panel 100 via the video signal transmitting line 132.

In this embodiment, the video signals are supplied in digital form, and are supplied to the liquid crystal panel 100 from the video signal control circuit 400 in such a specified form that a video image is formed in a display section 110 formed with pixels arranged in a matrix configuration. For example, data corresponding to one pixel is represented by plural bits (8 bits for displaying 256 gray scale levels), pixel data corresponding to a pixel row beginning from a pixel at a left-hand end and ending at a pixel at a right-hand end are transmitted successively in the liquid crystal panel 100, and transmission of pixel data for respective pixel rows are repeated successively from the top to bottom of the liquid crystal panel 100.

The video signal transmitting line 132 extends from the display control device 111 and is connected to the horizontal drive circuit 120 disposed around the display section 110. Plural video signal lines (also called drain signal lines or vertical signal lines) 103 extend from a horizontal drive circuit 120 in a vertical direction (a Y direction in FIG. 1), and the plural video signal lines 103 are arranged in a horizontal direction (an X direction in FIG. 1).

The horizontal drive circuit 120 selects gray scale voltage at its gray scale voltage selector circuit 123 based upon video signals, and then outputs the selected gray scale voltages to the video signal lines 103, which in turn transmits the selected gray scale voltages to the pixels 101. The gray scale voltages are supplied to the gray scale voltage selector circuit 123 from a voltage generator circuit 112 via gray scale line 133. The magnitude of the gray scale voltage via from the gray scale line 133 varies with time. The gray scale voltage selector circuit 123 selects a voltage level to be output from the time-varying gray scale voltage. On the other hand, a time control signal line 134 extends from the display control device 111, and is connected to the gray scale voltage selector circuit 123. Also the magnitude of a signal transmitted via the time control signal line 134 varies with time. The magnitude of the signal on the time control signal line 134 is related to the magnitude of the gray scale voltage on the gray scale voltage line 133. The voltage on the gray scale voltage line 133 is transmitted to the gray scale voltage selector circuit 123 based upon the signal on the time control signal line 134.

The vertical drive circuit 130 is disposed around the display section 110. A plurality of scanning signal lines (also called gate signal lines or horizontal signal lines) 102 extend in the horizontal direction (in the X direction) from the vertical drive circuit 130, and are arranged in the vertical direction (in the Y direction). The scanning signal lines 102 transfer scanning signals to switch on or off the switching elements disposed in the pixel section 101.

Furthermore, the pixel-potential control circuit 135 is disposed around the display section 110. A plurality of pixel-potential control lines 136 extend in the horizontal direction (in the X direction) from the pixel-potential control circuit 135, and are arranged in the vertical direction (in the Y direction). The pixel-potential control lines 136 transfer signals for controlling the potential of the pixel electrodes.

The reset circuit 137 is disposed around the display section 110, is connected to the video signal lines 103 such that the video signal lines 103 are reset.

Power supply lines for the respective circuits are omitted in FIG. 1, but it should be understood that necessary voltages are supplied to the respective circuits.

The following explains the basic operation of the liquid crystal panel 100 shown in FIG. 1.

The display control device 111 outputs a start pulse to the vertical drive circuit 130 via one of the control signal lines 131 when it receives the first display timing signal after receiving a vertical sync signal from an external equipment. Then, the display control device 111 outputs shift clocks successively to the vertical drive circuit 130 based on horizontal sync signals so that the scanning signal lines 102 can be selected successively with one horizontal scanning period (hereinafter referred to as 1*h*). The vertical drive circuit 130 selects the scanning signal lines 102 successively in synchronism with the shift clock, and outputs a scanning signal to a selected one of the scanning signal lines 102. More specifically, the vertical drive circuit 130 outputs a signal for selecting one of the scanning signal lines 102 during one horizontal scanning period 1*h* successively in the order starting from the top scanning line in FIG. 1.

The display control device 111 judges a time of receipt of the display timing signal as a time of a start of displaying in the horizontal direction, and outputs video signals to the horizontal drive circuit 120. The video signals are supplied successively from the display control device 111, and the horizontal shift register 121 outputs timing signals in synchronism with the shift clocks transmitted from the display control device 111. The timing signals represents a timing when the video signal selector circuit 123 takes in a video signal to be output to a corresponding one of the video signal lines 103.

In this embodiment, video signals are in digital form. The display control device 111 outputs digital data representing gray scale voltages to be supplied to respective video signal lines 103. The gray scale voltage selector circuit 123 has a function of serving as a so-called digital-analog conversion circuit. First the gray scale voltage selector circuit 123 records video signals in synchronism with timing signals, then selects gray scale voltages to be supplied to the video signal lines 103 based upon the video signals, and then supplies to a row of the pixels 101 selected by one of the scanning signal lines 102. Incidentally, a problem arises in the gray scale voltage selector circuit 123 in that the size of its circuit structures is excessively increased as the number of the gray scale voltage levels is increased.

The pixel-potential control circuit 135 controls a video signal voltage which has been written into a pixel electrode based upon a control signal from the display control device 111. A gray scale voltage written into the pixel electrode from the video signal line 103 has a potential difference from a reference voltage on the counter electrode. The pixel-potential control circuit 135 changes the potential difference between the pixel electrode and the counter electrode by supplying a control signal to the pixel 101. The pixel-potential control circuit 135 will be described in detail later.

The reset circuit 137 serves to set a voltage applied on the video signal lines 103 of the liquid crystal panel 100 to a specific value. Provision of the reset circuit 137 on the liquid crystal panel 100 enables the voltage applied on the video signal lines 103 to be set to a desired value. The reset circuit will also be explained in detail subsequently.

Figure 2:
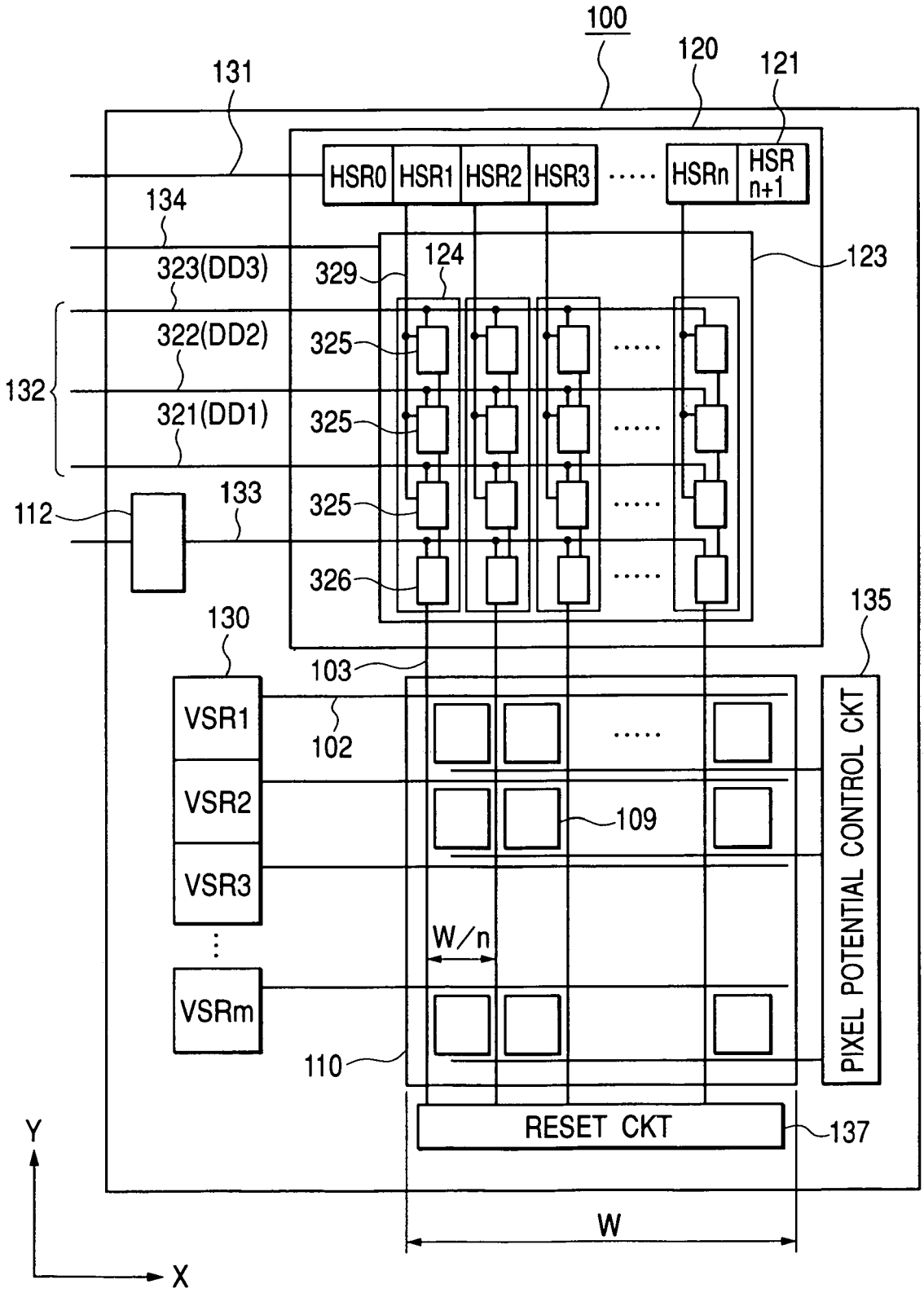
FIG. 2 is an equivalent circuit diagram of a liquid crystal display panel of an embodiment of the liquid crystal display device in accordance with the present invention.

FIG. 2 is a block diagram of the liquid crystal panel 100 employing an analog-digital conversion system in the horizontal drive circuit 120.

As explained above, the gray scale voltage selector circuit 123 serves as an analog-digital conversion circuit, is supplied with display data in digital form from the display data lines 132, and outputs gray scale voltages in analog form based upon the display data. When the number of gray scale levels to be displayed by the liquid crystal panel 100 is increased, the gray scale voltage selector circuit 123 is required to select a voltage level to be output to the video signal lines 103 from among many voltage levels. Also increased are the amount of data transmitted from the display control device 111 via the display data lines 132 connected to the gray scale voltage selector circuit 123. Consequently, when the number of gray scale levels to be displayed on the liquid crystal panel 100 is increased, a problem arises in that the number of the display data lines is excessively increased, and as a result the size of the circuit structures of the gray scale voltage selector circuit 123 is excessively increased. Therefore, it is necessary to configure the gray scale voltage selector circuit 123 to be fit for the driver-circuit-integrated type liquid crystal display device, to make its size as small as possible, and to arrange it efficiently within the liquid crystal panel 100.

FIG. 2 illustrates an arrangement of circuits constituting the gray scale voltage selector circuit 123. The gray scale voltage selector circuit 123 includes display data processing circuits 325 and gray scale voltage output circuits 326. A specified number of display data processing circuits 325 and one gray scale voltage output circuits 326 are arranged in an extension line of one of the video signal lines 103, and forms one of decoder circuit columns 124.

The display data line 132 comprising three display data lines 321-323 from the display control device 111 (not shown) is connected to the gray scale voltage selector circuit 123. Each of the display data lines 321-323 corresponds to one bit of the display data in digital form. Symbols DD1, DD2, DD3 enclosed in parentheses placed at the back of reference numerals 321, 322, 323 denoting the display data lines represent signals on the three display lines 321, 322, 323, respectively. Time-representing signals are supplied to the gray scale voltage selector circuit 123 via time control signal lines 134. In FIG. 2, for the sake of simplicity, only one of the time control signal lines 134 is shown, in actual circuit configurations, a necessary number of the time control signal lines 134 are provided. The time control signal lines 134 will be explained in detail in connection with FIG. 3 later. The display data lines 321-323 extend in a direction intersecting the decoder circuit columns 124, and are connected to the display data processing circuits 325 in the gray scale voltage selector circuit 123. Display data are successively output to the display data lines 321-323, and the horizontal shift register 121 outputs timing signals with which the display data are taken in synchronism. Timing signal lines 329 for supplying the timing signals extend from the horizontal shift register 121, and are disposed along the respective decoder circuit columns 124. Each of the timing signal lines 329 is connected to the display data processing circuits 325 belonging to a corresponding one of the decoder circuit columns 124 such that the timing signals are supplied to the respective display data processing circuits 325. Each of the decoder circuit columns 124 takes in signals on the display data lines 321-323 as display data representing a gray scale voltage to be output when it receives the timing signal.

Reference characters HSR1 to HSRn denote bidirectional shift registers of the horizontal shift register 121. The bidirectional shift registers HSR1 to HSRn output timing signals based upon signals (shift clocks) from the control signal line 131. The horizontal shift register 121 is connected to the control signal lines 131 from the display control device 111 (not shown) The bidirectional shift register HSR outputs the timing signals based upon signals (shift clocks) from the control signal line 131. Incidentally, the bidirectional shift registers HSR0 and HSRn+1 are dummy bidirectional shift registers.

In FIG. 2, the voltage generator circuit 112 is disposed on one of the substrates forming the liquid crystal display panel 100, and the gray scale voltage line 133 from the voltage generator circuit 112 is connected to the gray scale voltage output circuit 326. The grayscale voltage selector circuit 123 selects a voltage to be output from a voltage supplied from the gray scale voltage line 133 based upon the display data taken into the respective display data processing circuits 325, and then outputs the selected voltage.

The following explains the width of each of the decoder circuit columns 124. As shown in FIG. 2, a number n of video signal lines 103 are arranged at approximately equal intervals in the display section 110. A spacing between adjacent ones of the video signal lines 103 is approximately equal to the width of the pixel electrode 109 disposed in the display section 110. The number of the pixels to be provided in a given area of the display section 110 is determined by the related standards. Therefore, the area of the display section 110 and the number of the pixels determine the size of the area where one pixel is fabricated. The spacing between two adjacent ones of the video signal lines 103 is selected based upon the size of the area where one pixel is formed. For example, suppose that a number n of pixels are arranged in a horizontal direction (in the X direction) in the display section 110, and the width of the display section 110 is W. Then the pitch of the arrangement of the pixels is W/n, and the center-to-center spacing between the two adjacent video signal lines 103 is approximately equal to the pixel pitch W/n. The width of each of the decoder circuit columns 124 each arranged in an extension line of one of the video signal lines 103 needs to be selected to be approximately equal to the pixel pitch W/n. Further, the widths of the display data processing circuits 325 and the gray scale voltage selector circuit 123 need to be selected to be approximately equal to the pixel pitch W/n.

The decoder circuit columns 124 are disposed on extension lines of corresponding ones of the video signal lines 103 for supplying gray scale voltages thereto, and if the adjacent decoder circuit columns 124 are fabricated such that they overlap each other, there arise some problems. For example, wiring lines of the circuits are formed by patterning conductive films, and if two circuits are to be stacked one on another, conductive layers need to be laminated with an insulating layer interposed therebetween, and the number of processing steps increases, and consequently, productivity is thought to be degraded.

Now focus attention on an arbitrary one (an ith line) of the video signal lines 103. The display data processing circuits 325 and the gray scale voltage output circuit 326 constituting one of the decoder circuit columns 124 are arranged on an extension line of the ith one of the video signal lines 103. The display data processing circuits 325 and the gray scale voltage output circuit 326 constituting another of the decoder circuit columns 124 are arranged on an extension line of the (i+1)th one of the video signal lines 103. The decoder circuit columns 124 is equal in number to the number of the video signal lines 103, and are arranged successively. Therefore an area available for the display data processing circuits 325 and the gray scale voltage output circuit 326 is a limited space between two adjacent ones of the video signal lines 103 having a pixel pitch W/n. The widths of the display data processing circuits 325 and the gray scale voltage output circuit 326 are selected to be equal to or smaller than the pixel pitch so that the display data processing circuits 325 and the gray scale voltage output circuit 326 do not overlap the display data processing circuits 325 or the gray scale voltage output circuit 326 of the adjacent decoder circuit columns 124.

As explained above, there is an essential condition of pixel pitches in the liquid crystal display devices, and therefore consideration also needs to be given to the width or area of their drive circuit for driving pixels. That is to say, in a case where the size of the display section is reduced, or the pixel pitch is reduced due to an increase in number of pixels, the widths of circuits provided for each of the video signal lines needs to be selected to be equal to or smaller than the pixel pitch, and consequently, a problem arises in that a drive circuit having narrow circuit widths needs to be disposed within a narrow area.

In the present embodiment, in order to arrange the display data processing circuits 325 and the gray scale voltage output circuit 326 efficiently within the horizontal pixel pitch, a plurality of the display data processing circuits 325 are provided, each of which corresponds to a corresponding one of the display data lines 321-323, they are arranged in conformity with the arrangement of the display data lines 321-323, and they are disposed on an extension line of a corresponding one of the video signal lines 103. That is to say, a series combination of the plural display data processing circuits 325 and the gray scale voltage output circuits 326 forms one of the decoder circuit column 124 corresponding to one of the video signal lines 103.

As shown in FIG. 2, the display data lines 321-323 extend from the display control device 111 (not shown), and are connected to the display data processing circuits 325. This embodiment explains a case where three-bit display data representing eight gray scale levels are used, and the number of the display data lines 321-323 is three. In the present embodiment, for simplicity, a case will be described where the number of the display data lines is three, but it is possible to select an arbitrary number of the display data lines depending upon display data.

The display data processing circuits 325 are provided each of which is associated with a corresponding one of the display data lines 321-323, performs digital processing using a corresponding bit of display signals, and then transmits a processing result to the gray scale voltage output circuit 326. The gray scale voltage output circuit 326 is supplied with a gray scale voltage from the gray scale voltage line 133, and supplies to the video signal line 103, a gray scale voltage corresponding to the display data based upon the processing results from the display data processing circuits 325.

As described above, the spacing between the adjacent video signal lines 103 is limited by the size of the pixel electrodes 109 disposed in the display section 110. On the other hand, the spacing between two adjacent ones of the display data lines 321-323 can be selected to wide enough for each of the display data processing circuit 325 to be disposed therebetween. As shown in FIG. 2, the display data processing circuit 325 are plural in number, are arranged on an extension line (in the Y direction in FIG. 2) of one of the video signal lines 103, and each of the display data processing circuits 325 corresponds to one of the display data lines 321-323, and consequently, a series combination of the display data processing circuit 325 corresponding to one of the video signal lines 103 is disposed within a space between the adjacent ones of the video signal lines 103. However, the spacing between the adjacent display data lines cannot be made large freely, but it is necessary to make the spacing as small as possible.

Figure 3:
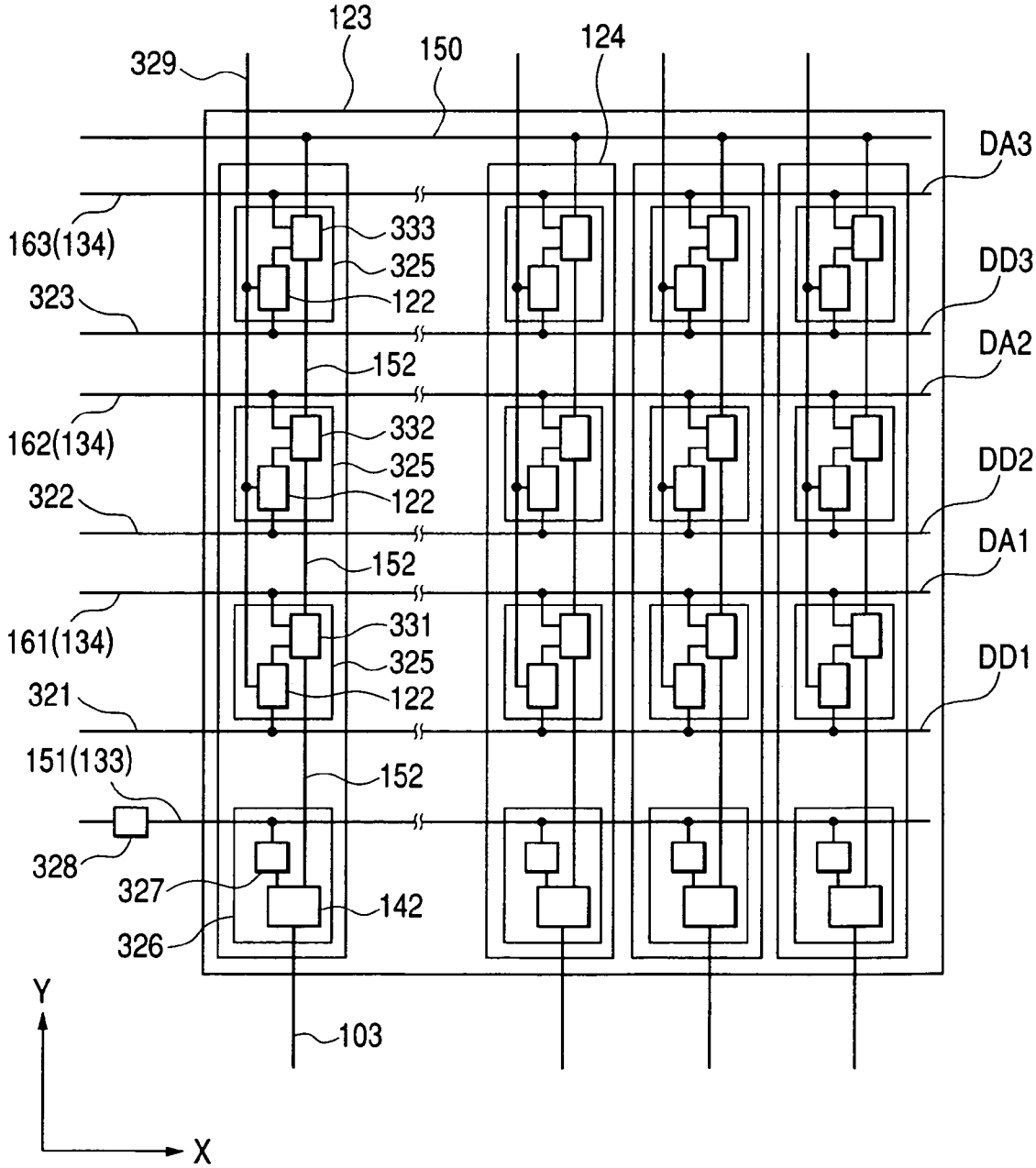
FIG. 3 is a block diagram for explaining a rough configuration of a gray scale voltage selector circuit in a liquid crystal display panel of an embodiment of the liquid crystal display device in accordance with the present invention.

The gray scale voltage selector circuit 123 for selecting a gray scale voltage by using the time control signal lines 134 will now be explained in detail by reference to FIG. 3. FIG. 3 is a rough block diagram illustrating a circuit configuration of the gray scale voltage selector circuit 123. As explained above, in the gray scale voltage selector circuit 123, each of the display data processing circuits 325 is disposed between adjacent ones of the display data lines 321-323, and the display data processing circuits 325 are coupled with the time control signal lines 134 as well as the display data lines 321-323.

To avoid complicating the figure, FIG. 3 illustrates a configuration of the decoder circuit columns 124 for four of the video signal lines 103. The plural decoder circuit columns 124 are arranged successively in the X direction in FIG. 3, but in FIG. 3, only one of the decoder circuit columns 124 at the left-hand side and three of the decoder circuit columns at the right-hand side are shown, and the remainder of the decoder circuit columns are omitted.

The decoder circuit columns 124 are equal in number to the number of the video signal lines 103. As the number of pixels is increased, and thereby the number of the video signal lines 103 is increased, a voltage bus line 151 for supplying a gray scale voltage to the gray scale voltage output circuits 326 is lengthened. The present inventors have found that wiring resistance of the lengthened voltage bus line 151 cannot be ignored. In the present invention, to eliminate the problem with the wiring resistance of the voltage bus line 151, a buffer circuit 327 is provided for each of the decoder circuit columns 124, and a buffer circuit 328 is provided for the voltage bus line 151. The buffer circuits 327, 328 will be explained in detail later.

The voltage selector circuit 123 is provided with the display data processing circuits 325 each of which is associated with a corresponding one of the display data lines 312-323. Each of the display data processing circuits 325 is connected to a corresponding one of the time control signal lines 134 (161-163) and the display data lines 321-323, and includes a display data hold circuit 122 and one of processing result transmitting circuits 331-333.

The display data hold circuits 122 store display data from the display data lines 321-323, respectively, in synchronism with a signal supplied by the horizontal shift register 121 via the timing signal line 329. Each of the processing result transmitting circuits 331-333 perform digital processing by using outputs from the display data hold circuit 122 and a signal from a corresponding one of the time control signal lines 161-163, and outputs its processing result to a processing result signal line 152. For example, each of the processing result transmitting circuits 331-333 can be formed of a processing circuit which is be formed of an AND circuit and a transmitting circuit which is formed of a gate circuit switched on or off by the processing result. The processing result transmitting circuits 331-333 are connected in series via the processing result signal lines 152, and transmit the processing result to the gray scale voltage output circuits 326. The processing result signal line 152 is supplied with a signal from a processing signal supply line 150.

The states represented by the processing-result transmitting circuits 331-333 connected in series via the processing result signal lines 152 are the following two states only:

(i) all of the processing-result transmitting circuits 331-333 are turned ON, and as a result the voltage on the processing signal supply line 150 is transmitted to the gray scale voltage output circuit 326; and (ii) at least one of the processing-result transmitting circuits 331-333 is turned OFF, and as a result the voltage on the processing signal supply line 150 is not transmitted to the gray scale voltage output circuit 326.

If the number of states transmitted to the gray-scale voltage output circuit 326 is only two, it is difficult for the gray scale voltage output circuit 326 to output a plurality of gray scale voltages.

To solve this problem, in the present embodiment, the gray scale voltage selector circuit 123 is provided with a signal voltage varying with time periodically (for example, a ramp voltage, a staircase voltage, and hereinafter may be called a periodically varying voltage) serving as a gray scale voltage, and is provided with time control signals varying in synchronism with the periodically varying voltage. The gray scale voltage selector circuit 123 determines a timing at which the periodically varying voltage becomes equal to a gray scale voltage level represented by supplied display data, based upon the time control signals, and outputs the desired gray scale voltage level. A value represented by time control signals are uniquely associated with respective levels of the periodically varying voltage.

For example, if the periodically varying voltage is configured to become equal to a gray scale voltage level represented by display data at a timing when a value represented by time control signals coincides with a value represented by display data, and the processing result transmitting circuits 331-333 are configured to be turned on when the value represented by time control signals coincides with the value represented by display data, by using AND circuits, for example, then a signal on the processing signal supply line 150 can be transmitted to the gray scale voltage output circuits 326 at a timing when the periodically varying voltage becomes equal to a gray scale voltage level represented by the display data.

The gray scale voltage output circuit 326 outputs a gray scale voltage to a video signal line 103 from its output gate circuit 142 based upon a signal (a processing result) transmitted by the processing result transmitting circuits 331-333. For example, the periodically varying voltage is supplied from the voltage bus line 151, a fixed voltage is supplied from the processing signal supply line 150, the gray scale voltages are supplied to the video signal lines 103 by controlling on-off operation of the output gate circuits 142.

Further, in another circuit configuration, the periodically varying voltage is supplied from the processing signal supply line 150, a high voltage is supplied from the voltage bus line 151, and the output gate circuits 142 each formed of an output amplifier amplify the periodically varying voltage, and then output it as a gray scale voltage to the video signal lines 103.

Incidentally, in FIG. 3, the voltage bus line is represented by only one line, but plural voltage bus lines can be employed instead. In a case where gray scale voltages are supplied in the form of periodically varying voltages, the number of the voltage bus lines can be reduced compared with that in a case where the voltage bus lines 151 is equal in number to the number of gray scale voltage levels to be displayed.

In this embodiment, a structure for supplying gray scale voltages is formed separately from the gray scale voltage selector circuit 123, and this configuration makes possible reduction in size of the circuit structure of the gray scale voltage selector circuit 123. A larger number of voltage lines is needed for supplying a large number of gray scale voltage levels, but if a time-varying gray scale voltage is utilized, a smaller number of voltage bus lines 151 can supply a larger number of gray scale voltage levels.

As explained above in connection with FIG. 2, the processing result transmitting circuits 331-333 and the gray scale voltage output circuit 326 are connected by a smaller number of processing result signal lines 152 than the number of the display data lines, and they form plural decoder circuit columns 124. Each of the decoder circuit columns 124 performs data processing between display data and time control signals, and thereby selects a gray scale voltage level to be output from the time-varying voltage on the voltage bus line 151, and consequently, wiring lines extending vertically in FIG. 2 are reduced in number. The data transmitted by the three display data lines 321-323 are processed by the three processing result transmitting circuits 331-333, then their processing results are transferred in the vertical direction via a single processing result signal line 152, and therefore the number of the wiring lines extending vertically (the Y direction in FIG. 2) is reduced. Further, the three processing result transmitting circuits 331-333 are arranged in the vertical direction, and as a result the width of the circuit configuration for outputting gray scale voltages to the video signal lines 103 can be reduced.

The following explains the operation of the voltage selector circuit 123 briefly. Initially display data are stored in the display data hold circuits 122 in synchronism with a timing signal output from the horizontal shift register 121. Then the display data stored in the display data hold circuits 122 are transmitted to the processing result transmitting circuits 331-333. Time control signals on the time control signal lines 161-163 vary with time, and the processing result transmitting circuits 331-333 perform digital processing by using the values from the display data hold circuits 122 and the values of the time control signals on the time control signal lines 161-163.

Each of the decoder circuit columns 124 is supplied with a signal from the processing signal supply line 150, and the processing results obtained by the processing result transmitting circuits 331-333 are transmitted to the gray scale voltage output circuit 326 by using the signal from the processing signal supply line 150.

When the voltage on the voltage bus line 151 becomes equal to a gray scale voltage represented by the display data, the gray scale voltage output circuit 326 outputs to the video signal line 103 the gray scale voltage from the voltage bus line 151 based upon the processing results obtained by the processing result transmitting circuits 331-333.

Figure 4:
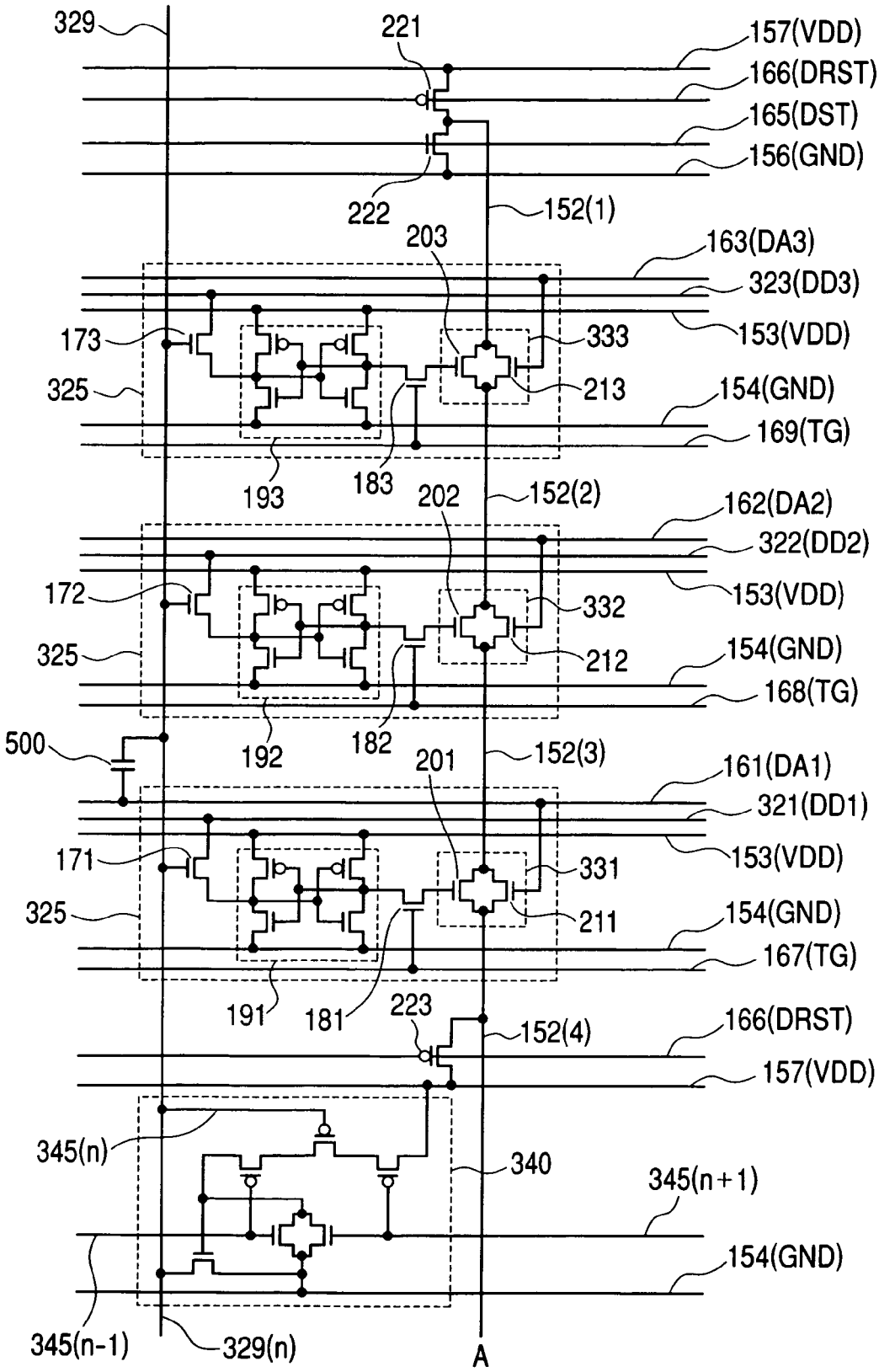
FIG. 4 is a block diagram for explaining a rough configuration of a gray scale voltage selector circuit in a liquid crystal display panel of an embodiment of the liquid crystal display device in accordance with the present invention.
Figure 5:
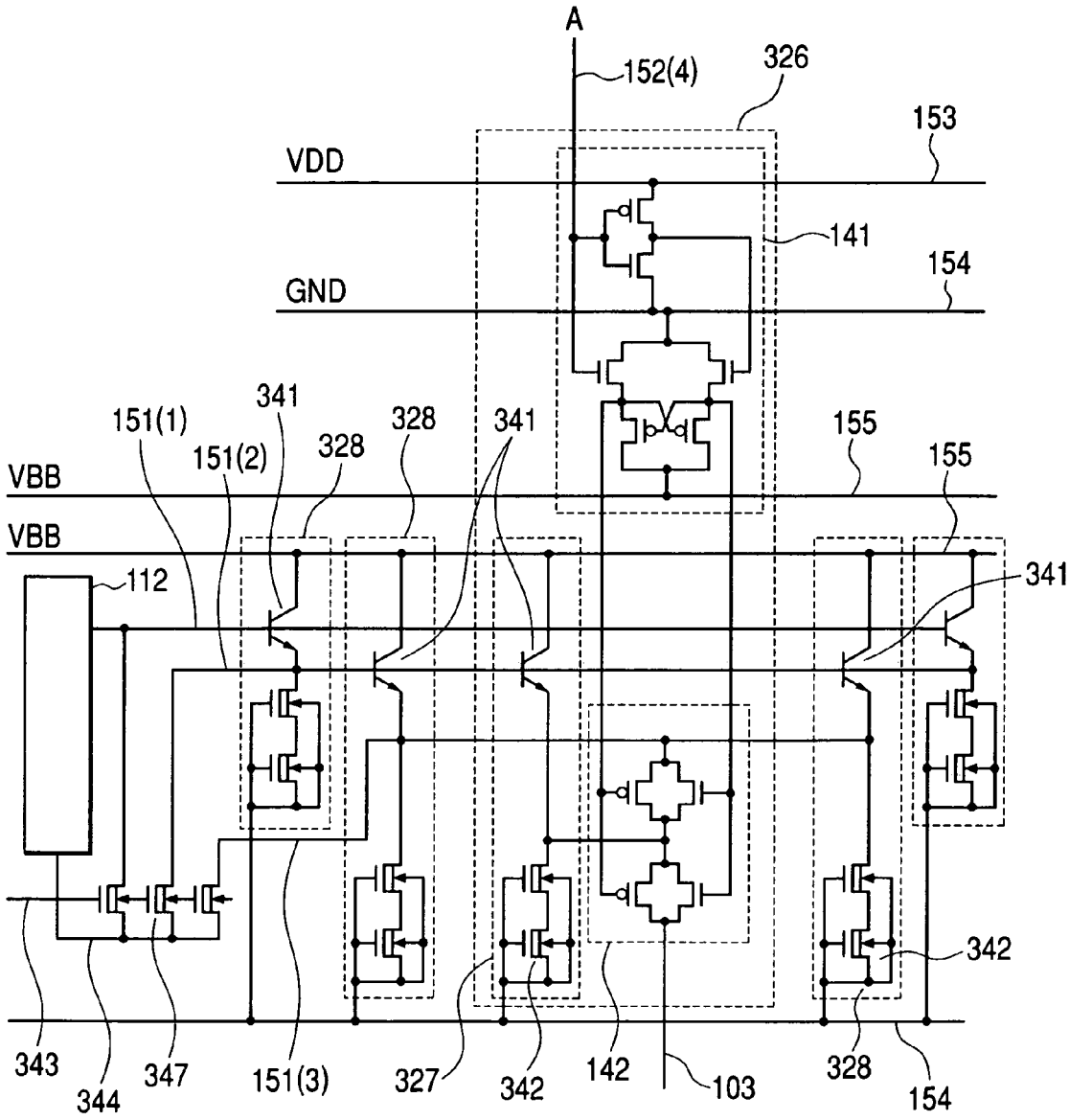
FIG. 5 is a circuit diagram for explaining a rough configuration of a gray scale output circuit of the liquid crystal display device in accordance with an embodiment of the present invention.

The following explains the display data processing circuits 325 in the gray scale voltage selector circuit 123 in detail by reference to FIG. 4. To avoid undue complication of FIG. 4, FIG. 4 illustrates a portion of the gray scale voltage selector circuit 123 associated with only one of the video signal lines 103. FIG. 4 illustrates a series combination of the three display data processing circuits 325, but the required number of the display data processing circuits 325 in one series combination is provided depending upon the number of gray scale levels to be displayed. The gray scale voltage output circuit 326 is illustrated in FIG. 5, and a point denoted by symbol A in FIG. 4 is connected to a point denoted by symbol A in FIG. 5. That is to say, FIGS. 4 and 5 illustrate two halves of the decoder circuit columns 124, respectively.

In FIG. 4, each of the processing result transmitting circuits 331-333 is formed of a parallel combination of two switching elements. Reference numerals 201-203 denote display data switching elements, and reference numerals denote time control signal switching elements. When a display data switching element or a time control signal switching element in one parallel combination of the two switching elements of one of the processing result transmitting circuits 331-333 is turned on, the one of the processing result transmitting circuits 331-333 is turned on. That is to say, the processing result transmitting circuits 331-333 perform an OR operation between display data and time control signals, and switch on or off a connection between the top and bottom processing result signal lines 152(1) and 152(4).

As explained above in connection with FIG. 3, the processing result signal line 152 is supplied with a signal from the processing signal supply line, and in FIG. 4, fixed-voltage lines 156, 157 serve as the processing signal supply lines for supplying fixed voltages. The voltage on one of the processing signal supply lines 156, 157 is transmitted to the gray scale voltage output circuits 326 via the processing result signal line 152 depending upon the processing results of the processing result transmitting circuits 331-333. Fixed voltage lines 156 and 157 supply power supply voltages GND and VDD, respectively. Reference numeral 165 denotes a processing-result-signal-line set signal line, and 166 is a processing-result-signal-line reset signal line.

In FIGS. 4 and 5, power supply lines are illustrated as fixed-voltage lines 153 and 154 for supplying the power supply voltages VDD and GND, respectively.

As explained above in connection with FIG. 3, when a processing circuit in each of the processing result transmitting circuits 331-333 is formed of an AND circuit, only when display data coincide with values of the time control signals, all of the processing result transmitting circuits 331-333 are turned on. On the other hand, as shown in FIG. 4, if each of the processing result transmitting circuits 331-333 is configured to perform an OR operation, there is a problem in that, even when one of a parallel combination of two switching elements is turned on, one of the processing result transmitting circuits 331-333 including the parallel combination is turned on.

The following explains the gray scale voltage selector circuit 123 employing the processing result transmitting circuits 331-333 illustrated in FIG. 4. Explained here is a decoding function of the gray scale voltage selector circuit 123 which selects a gray scale voltage level based upon display data, and a timing signal stabilizing circuit denoted by reference numeral 340 will be explained in detail after the explanation of the gray scale voltage selector circuit 123.

In FIG. 4, the display data processing circuits 325 include data take-in elements 171-173, memory circuits 191-193, and display data transfer elements 181-183 in addition to display data processing elements 201 and time control data processing elements 201-203. The display data processing circuits 325 is connected to the display data lines 321-323 for supplying display data, the time control signal lines 161-163 for supplying the time control signals, and transfer signal lines 167-169 for supplying a control signal TG for controlling the display data transfer elements 181-183.

The data take-in elements 171-173 transfer signals on the display data lines 321-323 to the memory circuits 191-193 when they are turned on by a signal from the timing signal line 329. The memory circuits 191-193 are formed of two cross-coupled inverters in which an output of one of the two inverters is connected to an input of another of the two inverters to form a latch circuit. Incidentally, the memory circuits 191-193 are not always formed of inverter circuits, but can be formed of various configurations capable of storing data such as by holding data with electrostatic capacitances.

When the data take-in elements 171-173 are turned on by the timing signal lines 329, signals on the display data lines 321-323 are input into the memory circuits 191-193, and then the inverted signals are output from the memory circuits 191-193. When the data take-in elements 171-173 are turned off, the memory circuits 191-193 hold the inverted signals.

When the display data transfer elements 181-183 are turned on by the control signal lines TG, the data held in the memory circuits 191-193 are transferred to the display data processing elements 201-203. The data have been inverted in the memory circuits 191-193, and therefore, when the display data are at a low level, high-level data are input to control terminals of the display data processing elements 201-203, and consequently, the display data processing elements 201-203 are made conducting.

When the display data processing elements 201-203 are made conducting by the display data, the processing result transmitting circuits 331-333 are conducting irrespective of the states of the time data processing elements 211-213. That is to say, when the display data are at a low level, the processing result transmitting circuits 331-333 do not serve as switching circuits. On the other hand, the display data are at a high level, the processing result transmitting circuits 331-333 serve as switching circuits which are switched on or off depending upon the signals on the time control signal lines 161-163.

FIG. 4 illustrates a case in which three display data processing circuits 325 are provided, but if the display data processing circuits 325 are m in number, for example, the gray scale voltage selector circuit 123 is configured to select one or more circuits which serve as switching circuits from among m processing result transmitting circuits depending upon display data. That is to say, the above configuration is capable of selecting $2^m$ combinations of switching circuits to be switched on or off depending upon the time control signals from among the m processing result transmitting circuits connected in series via the processing result signal line 152.

FIG. 4A shows variations of assignments of the three processing-result transmitting circuits 331, 332 and 333 for switching circuits. In FIG. 4A, "-" indicates that a processing result transmitting circuit is ON (conducting) at all times, and "SW" indicates that a processing result transmitting circuit serves as a switching circuit. Although the three processing result transmitting circuits 331, 332 and 333 are configured as switching circuits, if the processing result transmitting circuits are set to be ON at all times, the switching circuits can be considered absent and conducting.

In a case where the switching circuits are connected in series, only two states can be selected, one is that all the switching circuits are ON, and the other one is that at least one of the switching circuits is OFF. However, if, as shown in FIG. 4A, a number m of the switching circuits are configured such that, in each case, only a certain number of switching circuits can be selected from the number m of the switching circuits for switching operation, a number $2^m$ of different states can be selected.

Further, the processing result transmitting circuits 331-333 perform an OR operation, all the processing result transmitting circuits 331-333 can be turned on at the same time by signals other than the time control signals intended to turn on the switching circuits denoted by SW in FIG. 4A.

The following explains CASE 2 indicated in FIG. 4A by way of example. If the high and low levels are represented by "1" and "0", respectively, the display data for CASE 2 is represented as (1, 0, 0) in the order from the lowest-order bit. The display data are inverted in the memory circuits 191-193, and then are transferred to the display data processing elements 201-203. Therefore, in CASE 2, the display processing element 201 corresponding to the lowest-order bit of the display data is turned off, and only the processing result transmitting circuit 331 serves as a switching circuit. That is to say, in CASE 2, the processing result transmitting circuits 332 and 333 do not serve as switching circuits, and therefore, in a case where the time control signal turns on the time data processing element 211 of the processing result transmitting circuit 331, that is, a case where the time control signals are (1, 0, 0), (1, 1, 0), or (1, 1, 1), the processing result transmitting circuit 331 are turned on, and consequently, all the processing result transmitting circuits 331-333 are turned on.

To solve the above problem, the circuit shown in FIG. 4 is configured such that the gray scale voltage output circuit 326 takes a gray scale voltage into the video signal line 103 at a timing in which all the processing result transmitting circuits 331-333 are turned on by the time control signals for the first time. For example, in CASE 2, the gray scale voltage output circuits 326 takes a gray scale voltage into the video signal lines 103 at a timing in which the time control signals change to (1, 0, 0), and further, the voltage bus line 151 is kept cut off from the video signal line 103 until the gray scale voltage output circuits 326 is reset after the gray scale voltage has been taken into the video signal line 103.

As shown in FIG. 4A, the switching circuits SW are configured such that m switching circuits can form $2^m$ states, and the time control signal can select one from among the $2^m$ states. If the time control signals are selected to turn on the switching circuits SW on the increasing order of values represented by the switching circuits SW, the decoder circuit columns 124 which perform an OR operation shown in FIG. 4 can select a desired gray scale voltage level.

The following explains the setting and resetting operation of the gray scale voltage output circuits 326. Initially the time data processing elements 211-213 are set to be on, then the processing result signal line 152 is charged to a high level by turning on the processing-result-signal-line reset elements 221, 223 by the processing-result-signal-line reset signal line 166, and connecting the processing result signal line 152 to the fixed-voltage line 157. The processing result signal lines 152(2)-152(4) are kept to be charged at the high level by keeping the time data processing elements 211-213 in the off state after the above charging. Then, after the processing result signal line 152 is separated from the fixed-voltage line 157, the processing-result-signal-line set element 222 is turned on by the processing-result-signal-line set signal line 165, and thereby the processing result signal line 152(1) is electrically connected to the fixed-voltage line 156 (GND). If even one of the processing result transmitting circuits 331-333 is turned off, although the processing result signal line 152(4) is charged at the high level, if all the processing result transmitting circuits 331-333 are turned on by the time control signal lines 161-163, the processing result signal line 152(4) is connected to the fixed-voltage line 156 (GND), and thereby is discharged to a low level. After this, the processing result signal line 152 does not change to the high level until it is charged by the processing-result-signal-line reset signal line 166. In the gray scale voltage output circuits 326 explained subsequently, by connecting the voltage bus line 151 to the video signal line 103 during a time interval when the processing result signal line 152(4) is at the high level, and by disconnecting voltage bus line 151 from the video signal line 103 during a time interval when the processing result signal line 152(4) is at the low level, a voltage on the voltage bus line 151 immediately before the disconnection of the voltage bus line 151 from the video signal line 103 can be written into the video signal line 103.

The following explains the gray scale voltage output circuits 326 by reference to FIG. 5. In FIG. 5, reference numeral 141 denotes a level shift circuit, 142 is an output gate, 151 is a voltage bus line, 112 is a ramp voltage generator circuit, 327 is a buffer circuit provided for each of the gray scale voltage output circuits 326, and 328 is a buffer circuit provided to the voltage bus line 151. The above-explained processing result signal line 152(4) is connected to a point denoted by A in FIG. 5, and thereby the processing result is transferred to the gray scale voltage output circuits 326. A signal transmitted by the processing result signal line 152(4) is converted to a voltage capable of driving the output gate circuit 142 by the level shift circuit 141. When the output gate circuit 142 is turned on by the signal converted by the level shift circuit 141, a voltage on the voltage bus line 151 is output to the video signal line 103. The ramp voltage generator circuit 112 generates a ramp voltage varying with time in a staircase fashion, and output it to the voltage bus line 151.

As described above, initially the output gate 142 is in the on state, and the ramp voltage is supplied to the video signal line 103, and then when all the processing result transmitting circuits 331-333 which serve as switching elements based upon display data are turned on, the output gate circuit 142 is turned off, and thereby a desired gray scale voltage level is taken into the video signal lines 103.

Figure 6:
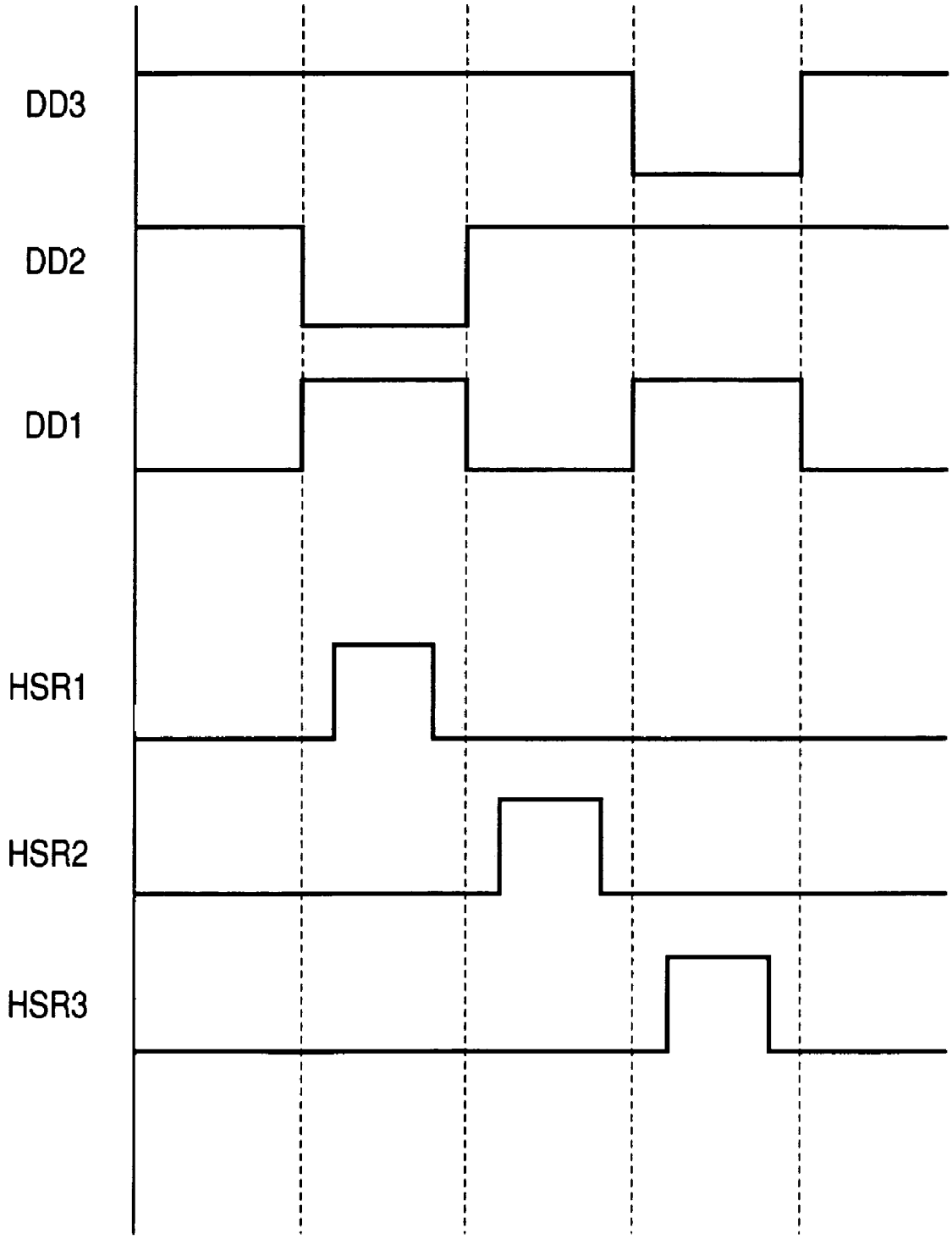
FIG. 6 illustrates waveforms of display data and timing signals for explaining the operation of the liquid crystal display device in accordance with an embodiment of the present invention.
Figure 7:
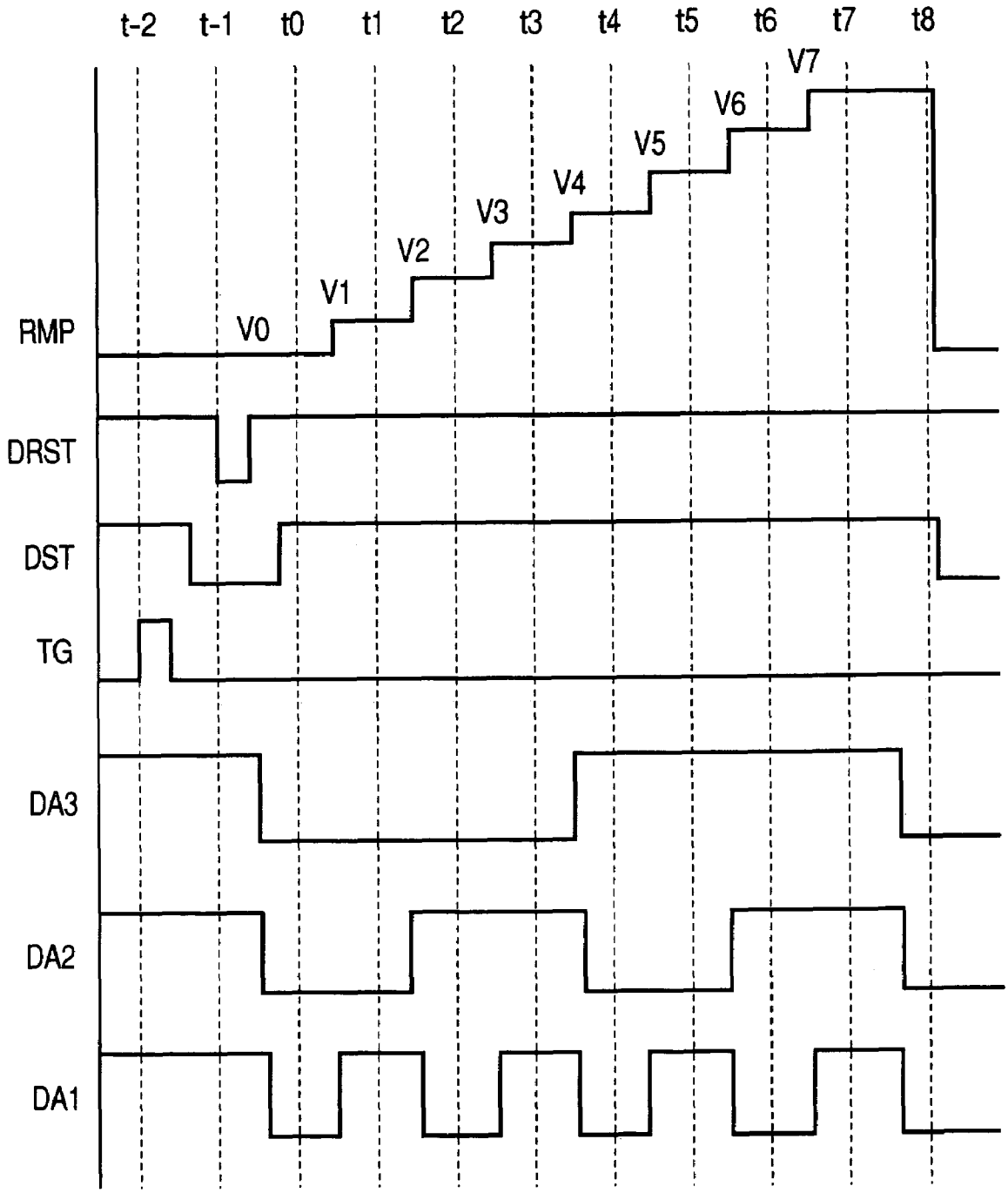
FIG. 7 illustrates wave forms of a gray scale voltage, time control signals and timing signals for explaining the operation of the liquid crystal display device in accordance with an embodiment of the present invention.

The following explains the operation of the circuit shown in FIGS. 4 and 5 by reference to timing charts of signals shown in FIGS. 6 and 7. The buffer circuits 327, 328 will be explained in detail after the explanation of the above-mentioned circuit.

FIG. 6 illustrates operation of taking in of the display data DD1-DD3 output to the display data lines 321-323, respectively, in synchronism with timing signals. Symbols DD1-DD3 represent display data output to the display data lines 321-323 shown in FIG. 4, respectively. Symbols HSR1-HSR3 represent timing signals output to the timing signal lines 329 from the horizontal shift register 121. In FIG. 6, only three timing signals HSR1-HSR3 are shown, but it is to be understood that a necessary number of the timing signals are output from the horizontal shift register in accordance with the number of the video signal lines. FIG. 4 illustrates only one of the timing signal lines 329 because FIG. 4 illustrates a configuration of only one of the decoder circuit columns 124 associated with one of the video signal lines 103, but the timing signals HSR1-HSR3 are output to three adjacent ones of the video signal lines 103 successively.

The display data DD1-DD3 represent three-bit data with DD1 being assigned to the lowest-order bit. During the time when the timing signal HSR1 is output, the display data DD1 is at a high level, the display data DD2 is at a low level, and the display data DD3 is at the high level. In the display data DD1-DD3 of this embodiment, the high and low levels are represented by "1" and "0", respectively, and therefore the above display data during the time when the timing signal HSR1 is output is represented as (1, 0, 1) in the order from the lowest-order bit.

In FIG. 4, in a state in which the display data DD1-DD3 are (1, 0, 1), when the timing signal HSR1 is output to the timing signal line 329, the data take-in elements 171-173 are turned ON, and thereby the display data on the display data lines 321-323 are taken into the memory circuits 191-193, respectively. The memory circuits 191-193 are formed of inverters, the data (0, 1, 0) inverted from the data (1, 0, 1) are output to the display data processing elements 201-203, respectively.

Operation after the display data have been taken into the display data hold circuit 122 will be explained by reference to FIG. 7. In FIG. 7, reference character RMP denotes a gray-scale voltage, which is supplied to the bus line 151 shown in FIG. 5 from the voltage generator circuit 112. The gray scale voltage RMP will be explained by taking as an example a voltage (a ramp voltage) varying with time in a staircase fashion as shown in FIG. 7, where the assignment is made such that when the display data are (0, 0, 0), a gray scale voltage V0 is written into a pixel electrode, and when the display data are (1, 1, 1), a gray-scale voltage V7 is written into a pixel electrode. The gray scale voltage RMP varies with time in a staircase fashion, and the time control signals DA1-DA3 also vary with time in synchronism with the ramp voltage RMP.

It is to be noted that the gray scale voltage RMP is not limited to a ramp voltage varying with time in a stair case fashion, but a voltage is suitable for the gray scale voltage RMP which varies with time and is uniquely associated with display data.

The following explains a case in which the display data DD1-DD3 are (1, 0, 1), are input into the memory circuits 191-193, and the data (0, 1, 0) are output to the display data processing elements 201-203 in FIGS. 6 and 7.

In FIG. 7, first, at time (t-2), the transfer signal TG changes to the high level, thereby the display data transfer elements 181-183 in FIG. 4 are turned on, and thereby the display data held in the memory circuits 191-193 are transferred to the display data processing elements 201-203. When the output from memory circuits 191-193 are (0, 1, 0), the display data processing elements 201 and 203 are turned off, and the display data processing element 202 are turned on.

Next, during a time interval from time (t-2) to time (t-1), and in a state in which the time control signals DA1-DA3 are at the high level, the processing-result-signal-line set signal DST is set to the low level such that a processing-result-signal-line set element 222 is turned off. The reason why initially the processing-result-signal-line set element 222 is turned off is that short-circuit between the fixed-voltage lines 156 and 157 is prevented.

Then, at time (t-1), the processing-result-signal-line reset signal DRST is set to the low level so that two processing-result-signal-line set elements 221 and 223 is turned on, and as a result the processing-result signal line 15 is connected to the fixed-voltage line 157 and is changed to the high level. At this time, since the time control signals DA1-DA3 are at the high level, all the processing result transmitting circuits 331-

333 are in the on state, and thereby all the processing result signal lines 152(1)-152(4) are discharged to the high level. When the processing result signal line 152 are at the high level, the output gate circuit 142 in the gray scale voltage output circuits 326 in FIG. 5 electrically connects the voltage bus line 151 to the video signal line 103. That is to say, during a time interval when the processing result signal line 152 is at the high level, the video signal lines 103 is supplied with a gray scale voltage from the voltage bus line 151.

Next, before time to, the processing-result-signal-line reset signal DRST is set to the high level so that the processing-result-signal-line reset elements 221, 223 are turned off. Thereafter, all the time control signals DA1-DA3 are set to the low level. When the processing-result-signal-line reset elements 221, 223 are turned off, the processing result signal line 152 is disconnected from the fixed-voltage line 157, and is still in a state charged to the high level. After this, the processing-result-signal-line set signal DST is changed to the high level so that the low-level ground potential (GND) is supplied to the processing result signal line 152(1) by the fixed-voltage line 156.

In FIG. 7, at time to, all the time control signals DA1-DA2 are at the low level, and therefore all the time data processing elements 211-213 are in the off state. Thereafter, at time t5, when the time control signals DA1-DA2 are the same as display data (1, 0, 1), all the processing result transmitting circuits 331-333 are turned on, and thereby the low-level ground potential (GND) supplied from the fixed-voltage line 156 is transmitted to the gray scale voltage output circuit 326 by the processing result signal line 152. When the gray scale voltage output circuit 326 receives the low-level signal from the fixed-voltage line 156, the output gate circuit 142 is turned off, and thereby the voltage bus line 151 is disconnected from the video signal line 103. After this, the gray scale voltage output circuits 326 is not turned on until it is reset, and consequently, the video signal lines 103 is maintained at a voltage VS on the voltage bus line 151 at the time of the above-mentioned electrical disconnection.

As explained in connection with FIG. 7, first the gray scale voltage output circuit 326 continues to supply a voltage to the video signal line 103, and at a timing when the voltage coincide with a desired voltage level, the gray scale voltage output circuits 326 is disconnected from the video signal line 103.

Therefore, in the operation of the gray scale voltage output circuits 326, if it happens that the same gray scale voltage level needs to be supplied to a large number of the video signal lines 103, the large number of the video signal lines 103 are disconnected from the voltage bus line 151 at the same time. If the large number of the video signal lines 103 are disconnected from the voltage bus line 151 at the same time, the load on the voltage bus line 151 changes suddenly.

The present inventors observed that smears (deviations in gray scale) occur in a display on a liquid crystal panel when the same gray scale level is displayed at many pixels at the same time, and that gray scale voltage levels supplied from the voltage bus line 151 are deviated from the intended level because of the sudden change in the load on the voltage bus line 151.

To solve the above-explained problem, in this embodiment, the buffer circuits 327 and 328 are provided in the gray scale voltage output circuits 326 as shown in FIG. 5. Each of the buffer circuits 327 and 328 is formed of an amplifying transistor 327 and a constant-current circuit 342. The constant-current circuit 342 serves to flow a constant current through the amplifying transistor 341, and consequently, even if the load on the voltage bus line 151 changes suddenly, variations in the gray scale voltages supplied from the output gate circuits 142 to the video signal lines 103 are prevented by suppressing variations in amount of the currents supplied to the output gate circuits 142.

The signal on the gray scale voltage line 151(1) passes through the buffer circuit 328, and enters the gray scale voltage line 151(2) for supplying the signal to the respective ones of the video signal lines 103. The buffer circuit 327 is provided to each of the video signal lines 103. The buffer circuit 327 serves as a buffer when it supplies a voltage to the video signal lines 103, but when it does not supply a voltage to the video signal lines 103, it ceases to serve as the buffer. The same gray scale voltage level can be supplied to all the video signal lines 103 having selected the same gray scale voltage level at the same time, and consequently, even when many of the video signal lines 103 have selected the same gray scale voltage, the variations in gray scale level can be suppressed among the video signal lines 103 having selected the same gray scale voltage level.

Returning to FIG. 5 again, the following explains supplying of the ramp voltage. In FIG. 5, the ramp voltage generator circuit 112 supplies the ramp voltage denoted by symbol RMP in FIG. 7 to the voltage bus line 151(1), which supplies the ramp voltage to a base electrode of the amplifying transistor 341 of the buffer circuit 328. A collector of the amplifying transistor 341 is connected to the fixed-voltage line 155, and is supplied with the voltage VBB. An emitter of the amplifying transistor 341 is connected to the voltage bus line 151(2), and outputs the ramp voltage to the voltage bus line 151(2).

The buffer circuit 327 is provided to each of the gray scale voltage output circuits 326. In FIG. 7, only one buffer circuit 327 is indicated, the buffer circuits 327 provided in the liquid crystal display device is equal in number to the number of the gray scale voltage output circuits 326. A base electrode of the amplifying transistor 341 of the buffer circuit 327 is connected to the voltage bus line 151(2), and an emitter of the amplifying transistor 341 supplies the ramp voltage to the output gate circuit 142. The ramp voltage is made much less subject to influences of variations in load by providing the buffer circuit 327 including the constant-current circuit 342 in each of the gray scale voltage output circuits 326.

In FIG. 5, reference numeral 343 denotes a reset signal line, and 347 is a voltage-bus-line reset switch. As shown in FIG. 7, the ramp voltage RMP varies with time, and at time 7, the voltage level of the ramp voltage RMP is V7. The ramp voltage needs to vary periodically, and therefore needs to return to the voltage level V0 again at time t8. At this time it is difficult for the ramp voltage generator circuit 112 to change the voltage on the voltage bus line 151(1) to the voltage V0, and also it is difficult to the voltages on the voltage bus lines 151(2) and 151(3) driven by amplifying transistors 341 rapidly to the voltage V0. Therefore, a voltage-bus-line reset switch 347 connects the voltage bus lines 151(1), 151(2), 151(3) to an output line 344 from the ramp voltage generator circuit 112. The output line 344 is set at the voltage V0 or a voltage near the voltage V0, and consequently, the voltage bus lines 151(1), 151(2), 151(3) are returned rapidly to a voltage near the voltage V0 via the voltage-bus-line reset switch 347.

Returning to FIG. 4 again, the following will explain the timing signal stabilizing circuit 340. As described above, the data take-in elements 171-173 are turned on when the timing signal line 329 changes to the high level. The timing signal lines 329 intersect the display data lines 321-323 and the time control signal lines 161-163, and consequently, form parasitic capacitance as denoted by reference numeral 500. Further, when the timing signal lines 329 are formed of conductive layers similar to gate electrodes of the data take-in elements 171-173, polysilicon layers, for example, their wiring resistance becomes relatively high. Therefore, charge stored in the parasitic capacitance 500 cannot be discharged toward the shift register, and as a result a time interval occurs when the timing signal lines 329 change to the high level. If the timing signal lines 329 change to the high level, the data take-in elements 171-173 are turned on, and a problem arises in that the data stored in the memory circuits 191-193 are lost.

As shown in FIG. 7, the time control signals DA1-DA3 are pulses, and in particular, the time control signal DA1 alternates between the high and low levels with a short period. Therefore, the present inventors have found that variations in the time control signal DA1 produce great influences on the timing signal lines 329. In view of this, the timing signal lines 329 are set at the low level by using the timing signal stabilizing circuit 340 (see FIG. 4). Further, as shown in FIG. 8, the time control signal DA1 are formed by transmitting a long-period signal S1 and a short-period signal S2 via two signal lines 348, and using an exclusive OR circuit 346 on the two signals S1 and S2 as explained in detail later.

The timing signal stabilizing circuit 340 are supplied with the (n−1)th timing signal from the timing signal reference line 345($n$−1), the nth timing signal from the timing signal reference line 345($n$), and the (n+1)th timing signal from the timing signal reference line 345($n$+1) (see FIG. 4).

Figure 9:
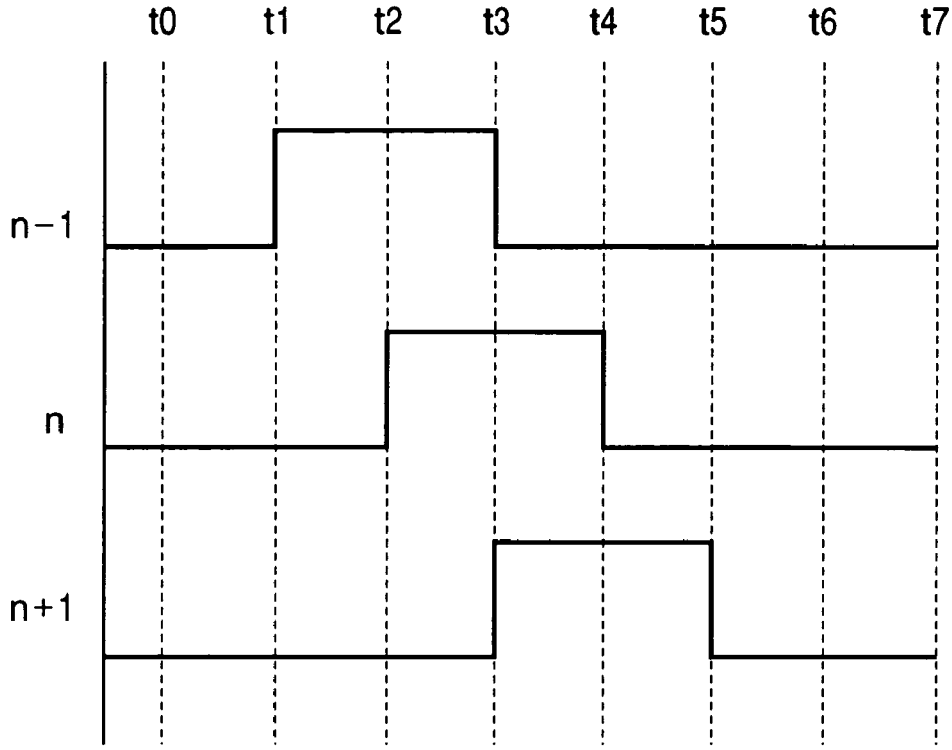
FIG. 9 illustrates waveforms of timing signals for explaining the operation of the liquid crystal display device in accordance with an embodiment of the present invention.

With the timing signal stabilizing circuit 340, during a time when all of the timing signals (n−1), n, (n+1) shown in FIG. 9 are at the low level, that is, before time t1, and after time t5, the nth timing signal line 329($n$) is connected to the power supply voltage line 154, and thereby is set at the low level (GND).

Figure 8:
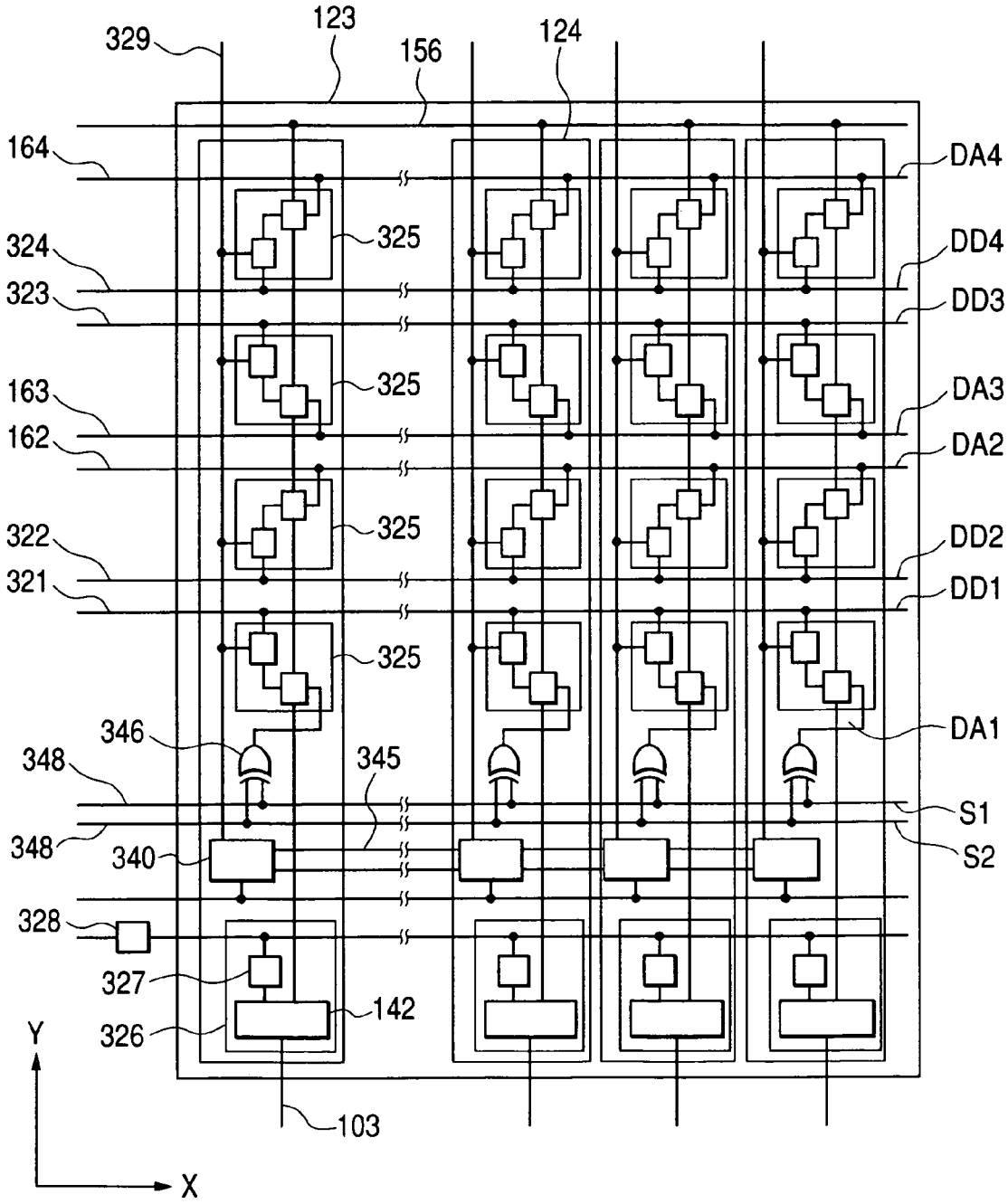
FIG. 8 is a circuit diagram for explaining a rough configuration of a voltage selector circuit of the liquid crystal display device in accordance with an embodiment of the present invention.
Figure 10:
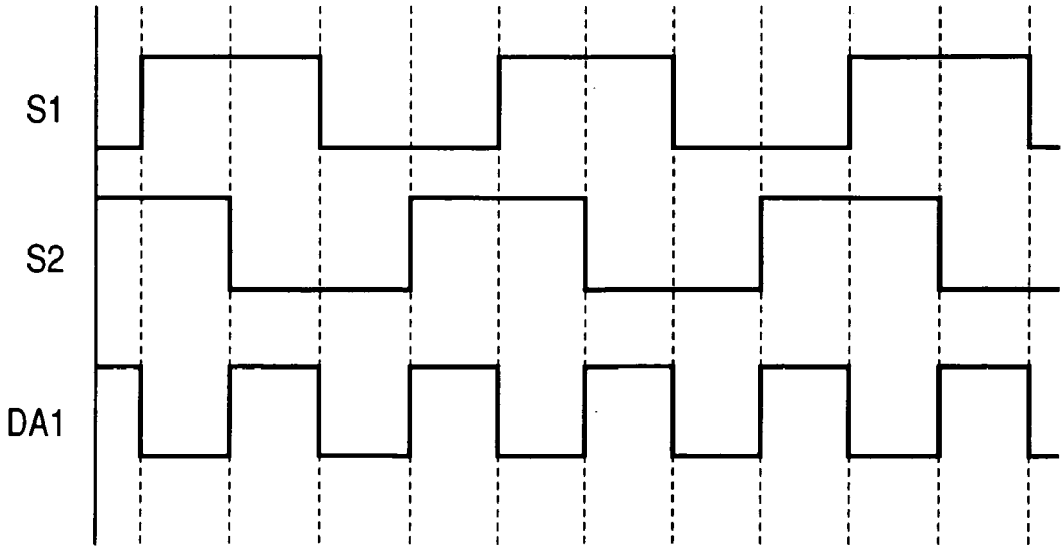
FIG. 10 illustrates waveforms of timing signals for explaining the operation of the liquid crystal display device in accordance with an embodiment of the present invention.

Further, the signals S1 and S2 as shown in FIG. 10 are supplied to the exclusive OR circuit 346 by the signal lines 348 shown in FIG. 8, and the exclusive OR circuit 346 outputs the time control signal DA1.

In the circuit configuration shown in FIG. 8, the time control signal DA1 are supplied by using the two signals S1 and S2 having two times the period of the time control signal DA1, and consequently, this can suppress influences of the time control signal DA1 on the timing signal line 329 intersecting the signal line 348.

Further, in the circuit shown in FIG. 8, two time control signal lines are disposed between the two vertically adjacent ones of the display data processing circuits 325. For example, two time control signal lines 162 and 163 are disposed adjacently to each other between the two vertically adjacent ones of the display data processing circuits 325. Variations in the signals on the time control signal lines is prevented from influencing other signals by arranging two time control signal lines adjacently to each other.

Figure 11:
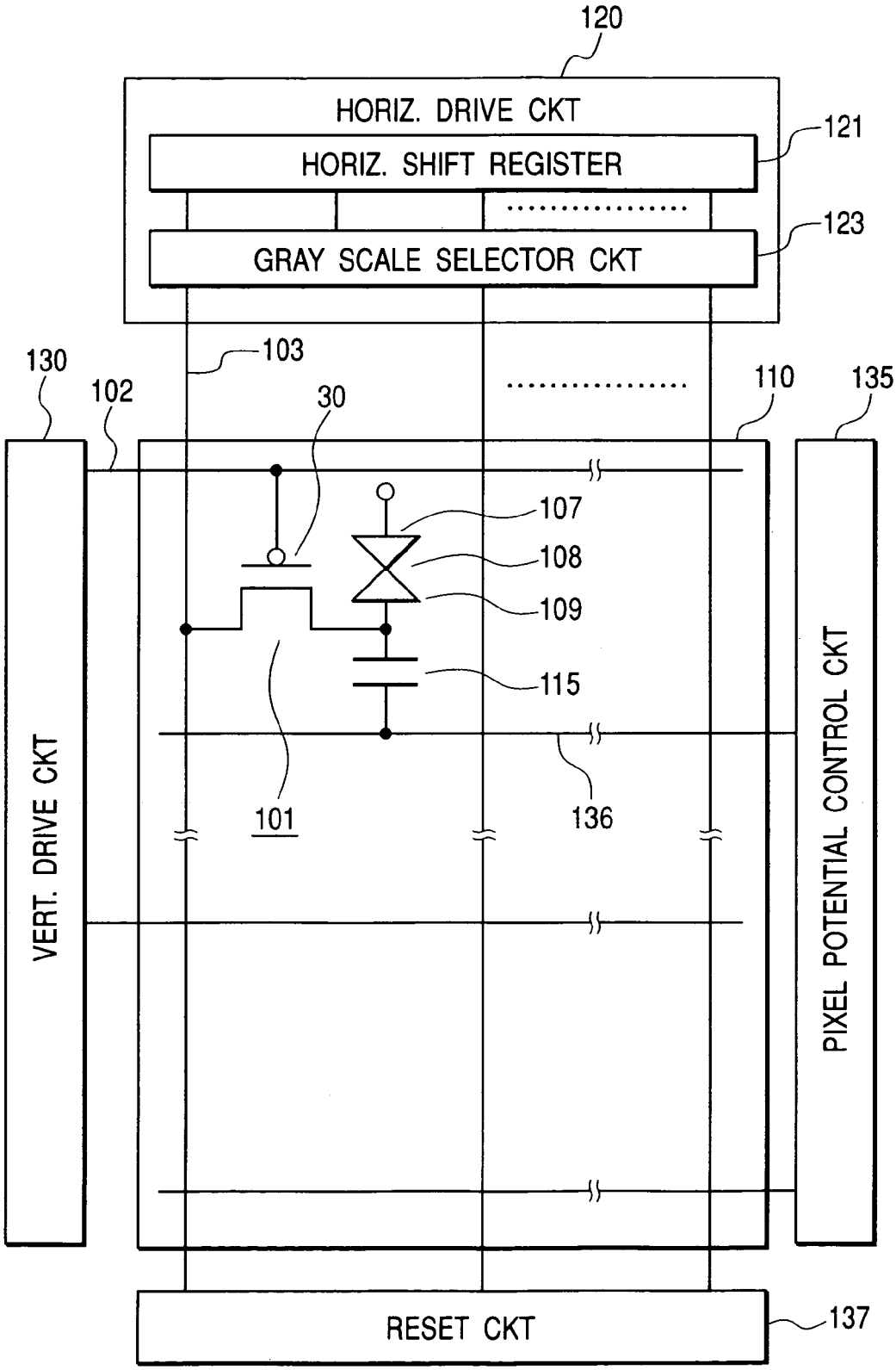
FIG. 11 is an equivalent circuit for explaining a pixel of the liquid crystal display device according to an embodiment of the present invention.

Next, the pixel 101 will be explained by referring to FIG. 11. FIG. 11 is a circuit diagram showing an equivalent circuit of the pixel 101. Each of the pixels 101 is disposed in an area surrounded by two adjacent ones of the scanning signal lines 102 and two adjacent ones of the video signal line 103 of the display section 110, and the pixels 101 are arranged in a matrix configuration. In FIG. 11, however, only one of the pixels 101 is shown to simplify the diagram. Each of the pixels 101 has an active element 30 and a pixel electrode 109, and a pixel capacitance 115 is coupled to the pixel electrode 109. One electrode of the pixel capacitance 115 is coupled to the pixel electrode 109, and the other electrode is coupled to the pixel-potential control line 136. The pixel-potential control line 136 is connected to the pixel-potential control circuit 135. In FIG. 11, the active element 30 is represented by a p-type transistor.

As described above, a scanning signal is output to the scanning signal line 102 from the vertical drive circuit 130. The scanning signal is used to perform on-or-off control of the active element 30. A gray scale voltage is supplied as a video signal to the video signal line 103. When the active element 30 is turned on, the gray scale voltage is supplied to the pixel electrode 109 from the video signal line 103. A counter electrode 107 (a common electrode) is disposed to face the pixel electrode 109, and a liquid crystal layer (not shown) is sandwiched between the pixel electrode 109 and the counter electrode 107. The circuit diagram of FIG. 11 is illustrated such that an equivalent capacitance 108 due to the liquid crystal layer is coupled between the pixel electrode 109 and the counter electrode 107. A display is produced by applying a voltage between the pixel electrode 109 and the counter electrode 107, thereby changing orientation and others of liquid crystal molecules, and causing changes in properties of the liquid crystal layer related to light.

In driving of the liquid crystal display device, an ac driving is employed to prevent a dc voltage from being applied across the liquid crystal layer. To perform the ac driving, a potential of the counter electrode 107 is set as a reference potential, and a positive-polarity voltage and a negative-polarity voltage with respect to the reference potential are output as gray scale voltages from the gray scale voltage selector circuit 123. However, when the gray scale voltage selector circuit 123 is designed to be a high-withstand-voltage circuit capable of withstanding a voltage difference between the positive-polarity voltage and the negative-polarity voltage, a problem arises in that the size of circuits including the active element 30 becomes larger, and operation speed is reduced.

Therefore, the present inventors studied an ac driving by supplying video signals of the same polarity with respect to the reference potential at all times to the pixel electrode 109 from the gray scale voltage selector circuit 123. For example, the gray scale voltage selector circuit 123 outputs a gray scale voltage of a positive polarity with respect to the reference potential. First the positive-polarity voltage with respect to the reference potential is written into the pixel electrode, and then by lowering the voltage of the pixel-potential control signal applied to the electrode of the pixel capacitance 115 from the pixel-potential control circuit 135, thereby reducing the voltage of the pixel electrode 109, a negative-polarity voltage with respect to the reference voltage can be generated on the pixel electrode 109. This driving method makes possible use of a low-withstand-voltage circuit as the gray scale voltage selector circuit 123 because of a small difference between the maximum and minimum voltages to be output from the gray scale voltage signal selector circuit 123. Here, the above explanation is made, by way of an example, of a case where initially the positive-polarity voltage is written into the pixel electrode 109, and then the negative-polarity voltage is generated on the pixel electrode 109 by using the pixel-potential control circuit 135, and it is also possible to generate a positive-polarity voltage on the pixel electrode 109 by raising the voltage of the pixel-potential control signal after initially writing a negative-polarity voltage into the pixel electrode 109.

Figure 12A:
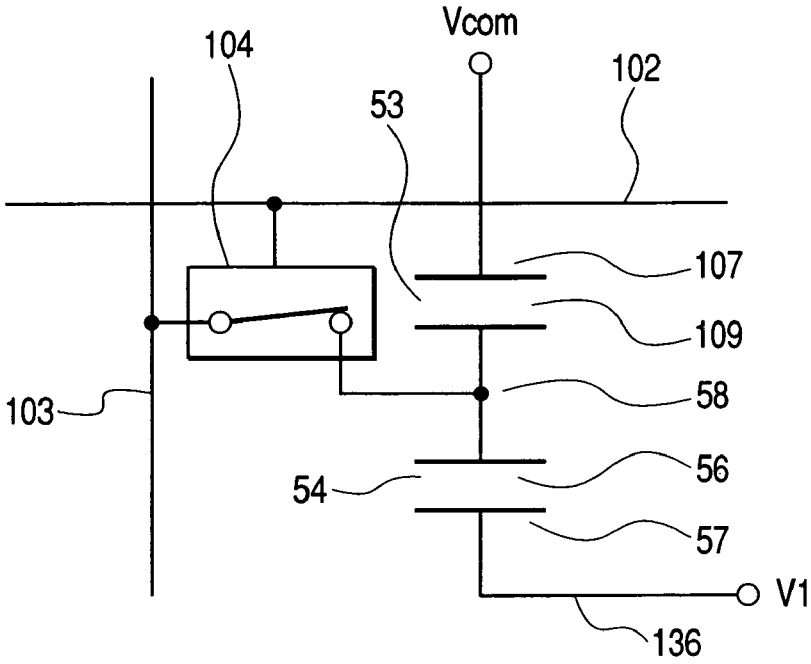
FIGS. 12A and 12B are schematic circuit diagrams for explaining a method of controlling the pixel potential of the liquid crystal display device according to an embodiment of the present invention.
Figure 12B:
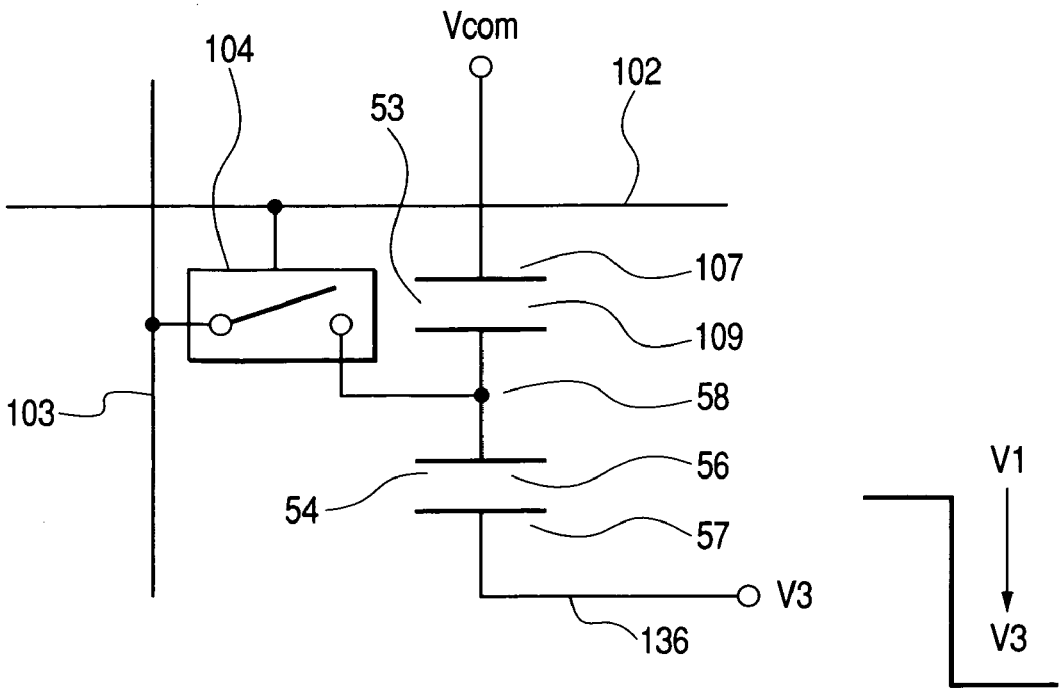

Next, a method of varying voltages on the pixel electrode 109 will be described by referring to FIGS. 12A and 12B. In FIGS. 12A and 12B, the liquid crystal capacitance 108 is represented by a first capacitor 53, the pixel capacitance 115 by a second capacitor 54 and the active element 30 by a switch 104, just for the purpose of explanation. An electrode of the pixel capacitance 115 to be coupled to the pixel electrode 109 shall be an electrode 56, and an electrode of the pixel capacitance 115 to be coupled to the pixel-potential control line 136 shall be an electrode 57. A connection point of the pixel electrode 109 and the electrode 56 is shown as a node 58. Here, for the explanation purpose, other parasitic capacitance are assumed to be negligible, and a capacitance of the first capacitor 53 is CL and a capacitance of the second capacitor 54 is CC.

First, as shown in FIG. 12A, a voltage V1 is externally applied to the electrode 57 of the second capacitor 54. Then, when the switch 104 is turned on by a scanning signal, a voltage is supplied to the pixel electrode 109 and the electrode 56 from the video signal line 103. Here, a voltage supplied to the node 58 shall be V2.

Next, as shown in FIG. 12B, the voltage (pixel-potential control signal) supplied to the electrode 57 is lowered from V1 to V3, when the switch 104 is turned off. At this time, since the total amount of electric charge charged in the first capacitor 53 and the second capacitor 54 does not change, the potential at the node 58 will change to $V2-\{CC/(CL+CC)\}\times(V1-V3)$.

Here, if the capacitance CL of the first capacitor 53 is sufficiently smaller than the capacitance CC of the second capacitor 54 ($CL \ll CC$), $CC/(CL+CC) \approx 1$, and the voltage at the node 58 will be $V2-V1+V3$. Here, if $V2=0$ and $V3=0$, the voltage at the node 58 will be $-V1$.

With the method explained above, the voltage supplied to the pixel electrode 109 from the video signal line 103 is selected to be positive with respect to the reference potential on the counter electrode 107, the negative-polarity voltage on the pixel electrode is generated by controlling the voltage applied on the electrode 57 (the pixel-potential control signal). When the negative-polarity signal is generated by using the above method, it is not necessary to supply the negative-polarity signal from the gray scale voltage selector circuit 123, and consequently, the peripheral circuits of the liquid crystal display panel can be composed of small-withstand-voltage elements.

Figure 13:
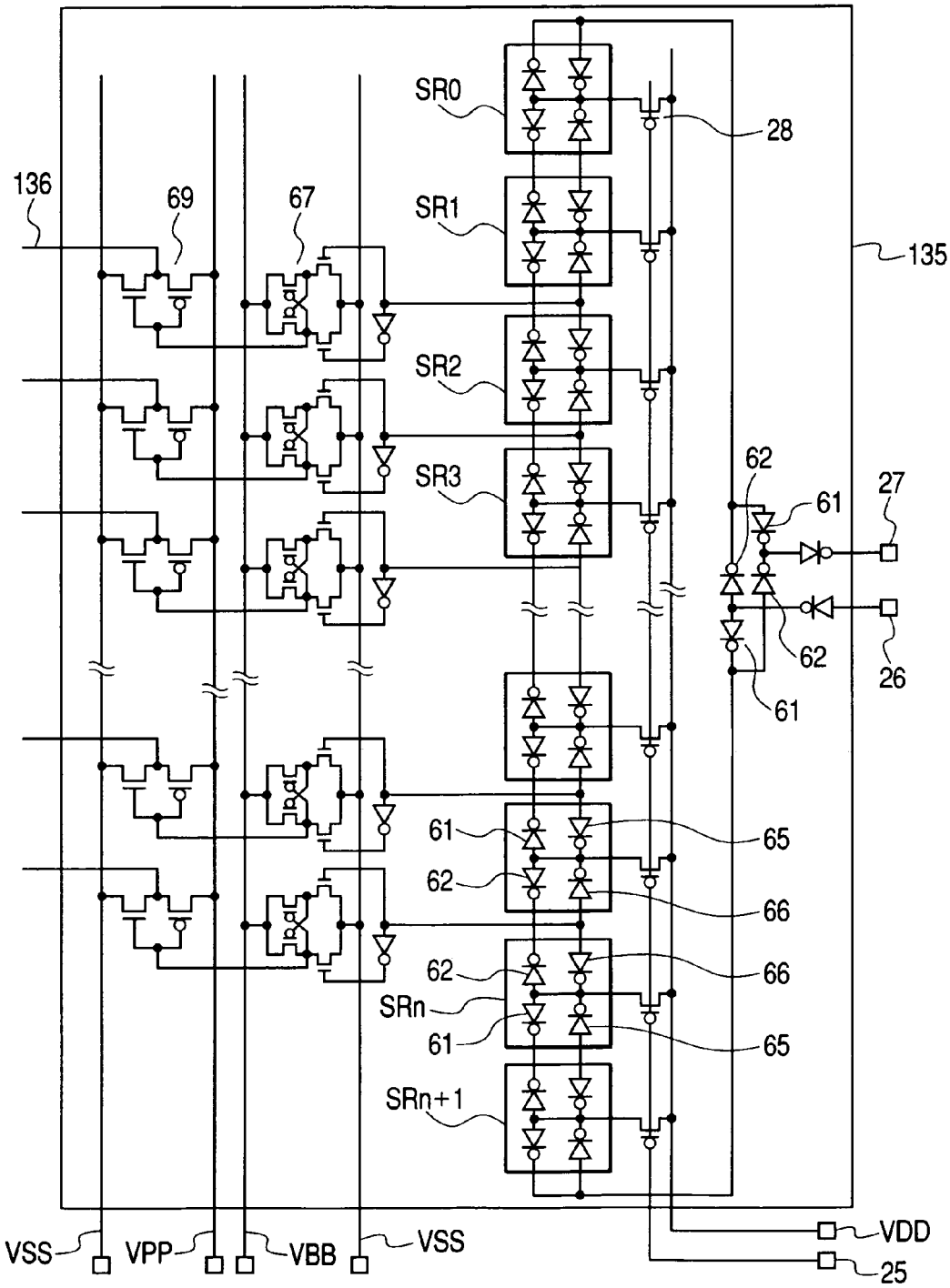
FIG. 13 is a schematic circuit diagram illustrating a configuration of a pixel potential control circuit of the liquid crystal display device according to an embodiment of the present invention.

A circuit configuration of the pixel-potential control circuit 135 is shown in FIG. 13. Symbol SR are bidirectional shift registers, which can shift signals upward and downward. Each of the bidirectional registers SR is composed of clocked inverters 61, 62, 65 and 66. Reference numeral 67 are level shifters, and reference numeral 69 are output circuits. The bidirectional registers SR, etc. are operated by a power-supply voltage VDD. The level shifters 67 convert the voltage level of a signals to be output from the bidirectional registers SR. The level shifters 67 output signals which have an amplitude between the power-supply voltage VBB higher than the power-supply voltage VDD and a power-supply voltage VSS (GND potential). The output circuit 69 is supplied with a power-supply voltage VPP and the voltage VSS, and outputs the voltages VPP and VSS to the pixel-potential control line 136 according to the signal from the level shifter 67. The above-mentioned voltage V1 of the pixel-potential control signal is the power-supply voltage VPP, and the voltage V3 is the power-supply voltage VSS. In FIG. 13, the output circuit 69 is represented by an inverter comprising a p-type and a n-type transistor. By selecting the values of the power-supply voltage VPP to be supplied to the p-type transistor, and the power-supply voltage VSS to be supplied to the n-type transistor, it is possible to output the voltages VPP and VSS as the pixel potential control signal. However, since a silicon substrate forming the p-type transistor is supplied with a substrate voltage, the value of the power-supply voltage VPP is set properly with respect to the substrate voltage.

Reference numeral 26 is a start signal input terminal which supplies a start signal which is one of control signals, to the pixel potential control circuit 135. Bidirectional shift registers from SR1 to SRn shown in FIG. 13 successively output timing signals in synchronism with timing of an externally supplied clock signal, upon receipt of the start signal. The level shifters 67 output the voltages VSS and VBB in accordance with a timing signal. The output circuits 69 output the voltages VPP and VSS to the pixel potential control line 136 according to the output from the level shifter 67. The start signal and the clock signal are supplied to the bidirectional shift registers SR in such a manner as to provide timing for the pixel-potential control signal. This make it possible to output the pixel potential control signal from the pixel-potential control circuit 135 with a desired timing. Reference numeral 25 denotes a reset signal input terminal.

The bidirectional shift registers SR are formed of clocked inverters, and therefore it is possible to successively output the timing signals. Further, by providing the pixel potential control circuit 135 composed of the bidirectional shift registers SR, it is possible to scan the pixel potential control signal bidirectionally. More specifically, the vertical drive circuit 130 is also composed of similar bidirectional shift registers, and therefore, the liquid crystal display device according to the present invention enables scanning upward and downward. Consequently, in the case of reversing the scanning direction, etc., the scanning is performed from bottom to top of the illustration in the figure by reversing the scanning direction. For this purpose, when the vertical drive circuit 130 performs scanning from bottom to top, the pixel potential control circuit 135 is adjusted to scan from bottom to top. The horizontal shift register 121 and a scanning circuit for testing are also formed of similar bidirectional shift registers.

For the purpose of clocked inverter construction and operation, U.S. Pat. No. 5,404,151 issued to Asada on Apr. 4, 1995 is hereby incorporated by reference.

Figure 14:
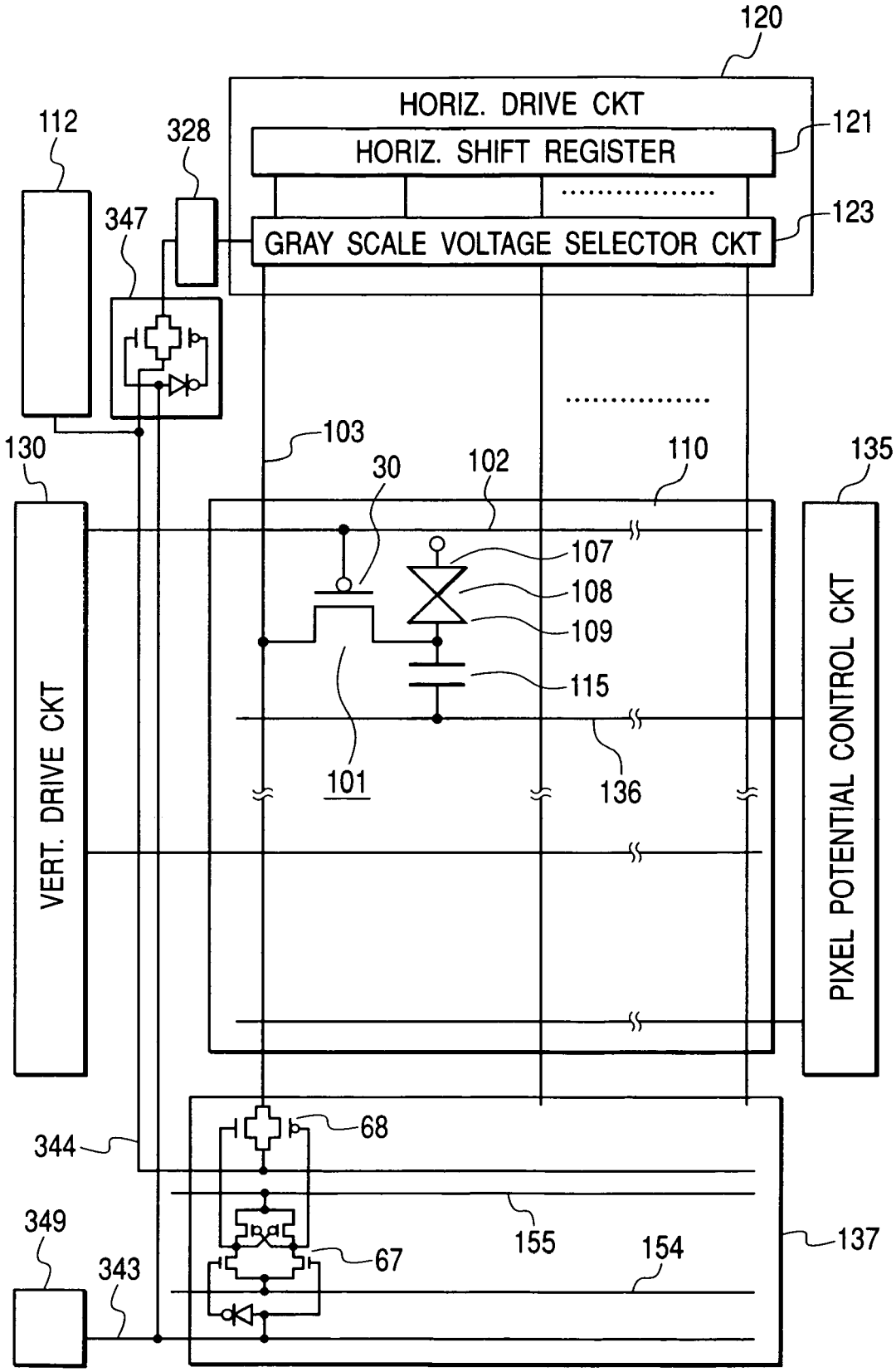
FIG. 14 is a schematic circuit diagram illustrating a configuration of a reset circuit of the liquid crystal display device according to an embodiment of the present invention.

The following explains the reset circuit 137 by reference to FIG. 14. The reset circuit has a function of connecting the video signal line 103 with the output line 344 of the ramp voltage generator circuit 112. The reset circuit 137 connects the video signal line 103 with an output line 344 by turning on an analog switch 68 by a reset signal supplied from a reset signal generator circuit 349 via a reset signal line 343. As explained above, the output line 344 outputs the voltage equal to or close to the voltage level V0 of the ramp voltage, and consequently, the video signal line 103 is brought to a voltage close to the voltage V0 rapidly by the reset circuit 137. Reference numeral 67 denotes a level shift circuit. Further, the reset signal line 343 supplies a reset signal to the above-explained voltage-bus-line reset switch 347 also, and the reset signal generator circuit 349 resets the voltage bus line to a voltage close to the voltage V0 as in the case of the video voltage line 103.

As described above, the gray scale voltage selector circuit 123 outputs the gray scale voltage to the video signal lines 103, and therefore, the video signal lines 103 are charged to gray scale voltages at the end of one horizontal scanning period 1H. During the next horizontal scanning period, the gray scale voltage selector circuit 123 outputs the ramp voltage RMP as shown in FIG. 7, for example. The video signal lines 103 are charged with the gray scale voltages, but the voltage generator circuit 112 needs to return the video signal lines 103 to the voltage V0 for the output start at the beginning of the output of the ramp voltage. In view of this, if the reset circuit 137 returns the video signal lines 103 rapidly to ground potential at the end of one horizontal scanning period, the load on the voltage generator circuit 112 is reduced, and thereby the video signal lines 103 can be reset in a short time.

The following explains the reflective type liquid crystal display device will be described. An electrically controlled birefringence mode is known as an example of a reflective type liquid crystal display element. In the electrically controlled birefringence mode, a voltage is applied between a reflective electrode and a counter electrode to vary the orientation of molecules of liquid crystal composition, thereby changing birefringence in the liquid crystal layer. The electrically controlled birefringence mode utilizes such changes in the birefringence as changes in the light transmission and forms an image.

Figure 15B:
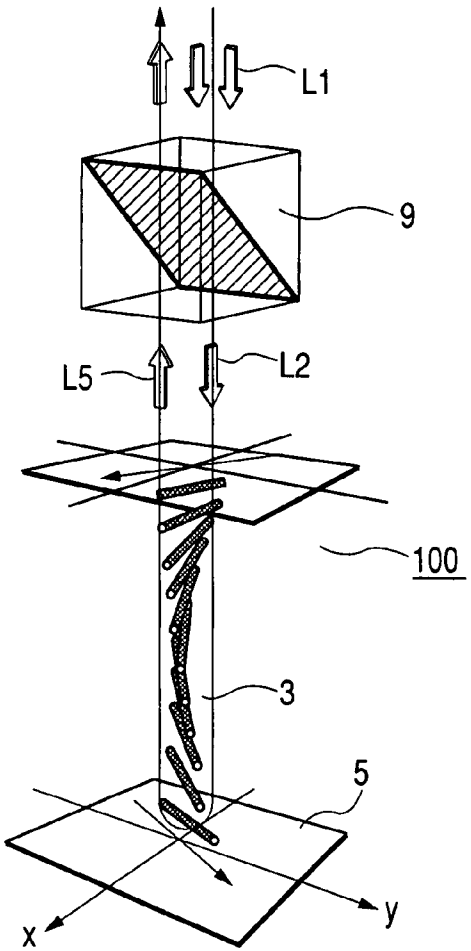
FIGS. 15A and 15B are schematic illustrations for explaining operations of the liquid crystal display device according to the an embodiment of the present invention.
Figure 15A:
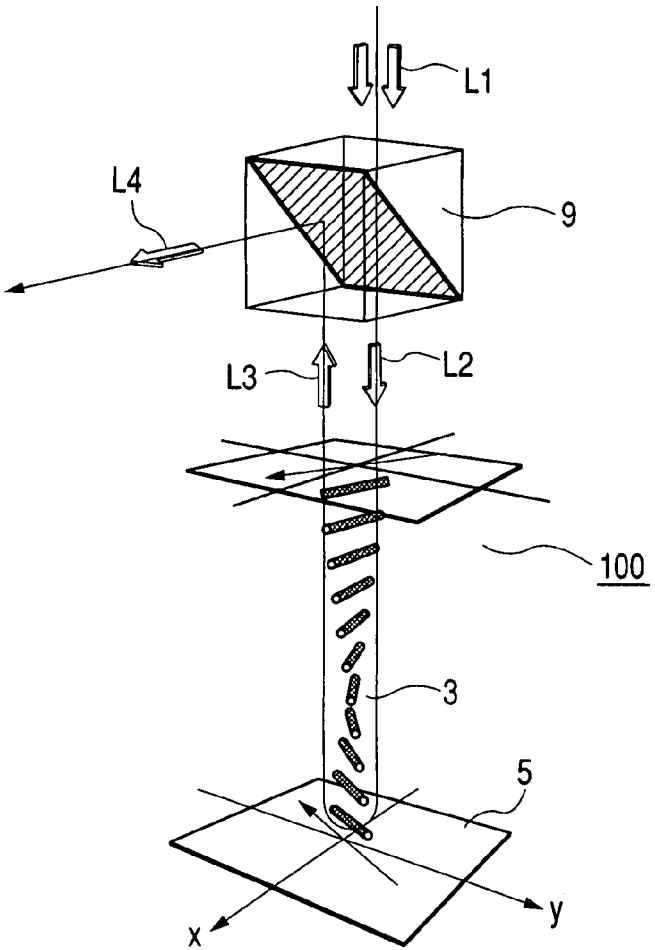

FIGS. 15A and 15B illustrate a single-polarizer twisted-nematic mode (SPTN), which is one of the electrically controlled birefringence modes. Reference numeral 9 is a polarizing beam splitter, which splits incident light L1 from a light source (not shown) into two polarized lights, and projects light L2 which has linearly polarized. FIGS. 15A and 15B illustrates a case where p-polarized light which is transmitted through the polarizing beam splitter 9 is used as light incident on the liquid crystal panel 100. However, it is possible to use s-polarized light which is reflected from the polarizing beam splitter 9. The liquid crystal composition 3 has major axes of liquid crystal molecules in parallel with the drive-circuit substrate 1 and the transparent substrate 2, and is made of a nematic liquid crystal material of positive dielectric anisotropy. The liquid crystal molecules are oriented to be twisted through about 90 degrees between the drive-circuit substrate 1 and the transparent substrate 2 by orientation films 7, 8 (not shown).

First, FIG. 15A illustrates a case where no voltage is applied across a liquid crystal layer. Light incident on the liquid crystal panel 100 becomes elliptically polarized light due to the birefringence of the liquid crystal composition 3, and subsequently becomes circularly polarized light on the surface of the reflective electrode 5. The light reflected from the reflective electrode 5 transmits through the liquid crystal composition 3 again to be elliptically polarized light again. The light returns to a linearly polarized light at the time it leaves the liquid crystal composition, and is then projected as light L3 (s-polarized light) whose phase is rotated by 90 degrees relative to that of the incident light L2. The projected light L3 enters the polarizing beam splitter 9 again, and it is reflected on the plane of polarization to be projected light L4. An image is obtained by projecting the light L4 onto a screen. This is the so-called normally white (normally open) display method wherein light is projected from the liquid crystal layer while no voltage is applied across the liquid crystal layer.

On the other hand, FIG. 15B illustrates a case where a voltage is applied across a layer of the liquid crystal composition 3. When a voltage is applied across the layer of the liquid crystal composition 3, liquid crystal molecules are oriented in a direction of electric fields, and therefore, the degree of birefringence within the liquid crystal layer will decrease. Consequently, the linearly polarized light L2 which has entered the liquid crystal panel 100 is reflected from the reflective electrode 5 as it is, and is projected as light L5 which is polarized in the same direction as the incident light L2. The projected light L5 transmits through the polarizing beam splitter 9 and returns to the light source. Under such arrangement, no light is projected onto the screen, etc. to provide a black image.

In the single-polarizer twisted-nematic mode, the orienting direction of liquid crystal molecules is parallel to the substrate, and it is possible to use a usual method of orienting which is good in processing stability. In addition, since the single-polarizer twisted-nematic liquid crystal display panel is operated under the normally white display mode, greater latitude can be allowed for defective display which may occur on the low operating voltage side. More specifically, the normally white display method provides a dark level (black image) when a high voltage is applied across the liquid crystal layer. When the high voltage is applied across the liquid crystal layer, since almost all liquid crystal molecules are oriented in a direction of the electric field which is perpendicular to the plane of substrate, a display at the dark level is not too dependent on an initial oriented state produced at the time of application of a low voltage. Further, the human eye perceives nonuniformity in luminance as a relative ratio of luminance, and is responsive approximately to the logarithm of luminance. Consequently, the human eye is sensitive to changes at a dark level. For this reasons, the normally white method is a display method advantageous against nonuniformity in luminance caused by the initial oriented state.

However, the above-explained electrically controlled birefringence mode requires high-precision cell gaps. More specifically, since the electrically controlled birefringence mode utilizes a phase difference between extraordinary rays and ordinary rays which is caused while the light passes through a liquid crystal layer, the intensity of the transmitting light is dependent on the retardation $\Delta n \cdot d$ between extraordinary rays and ordinary rays, where $\Delta n$ is birefringence, and d is a cell gap established by spacers 4 between the transparent substrate 2 and the drive-circuit substrate 1.

Therefore, in the present embodiment, the cell gap accuracy is selected to be ±0.05 μm or below, considering nonuniformity in display. In addition, since light incident on the liquid crystal is reflected from the reflective electrode and passes through the liquid crystal layer again in the reflective type liquid crystal display element, the cell gap d is selected to be half that of a transmissive type liquid crystal display element when a liquid crystal composition having the same birefringence $\Delta n$ is used. While the cell gap for a usual transmissive type liquid crystal display element is selected to be 5 to 6 μm, the cell gap employed in the present embodiment is about 2 μm.

To deal with highly accurate and narrower cell gaps, the present embodiment employs a method of forming column-like spacers on the drive-circuit substrate instead of the conventional method of scattering beads between the substrates.

Figure 16:
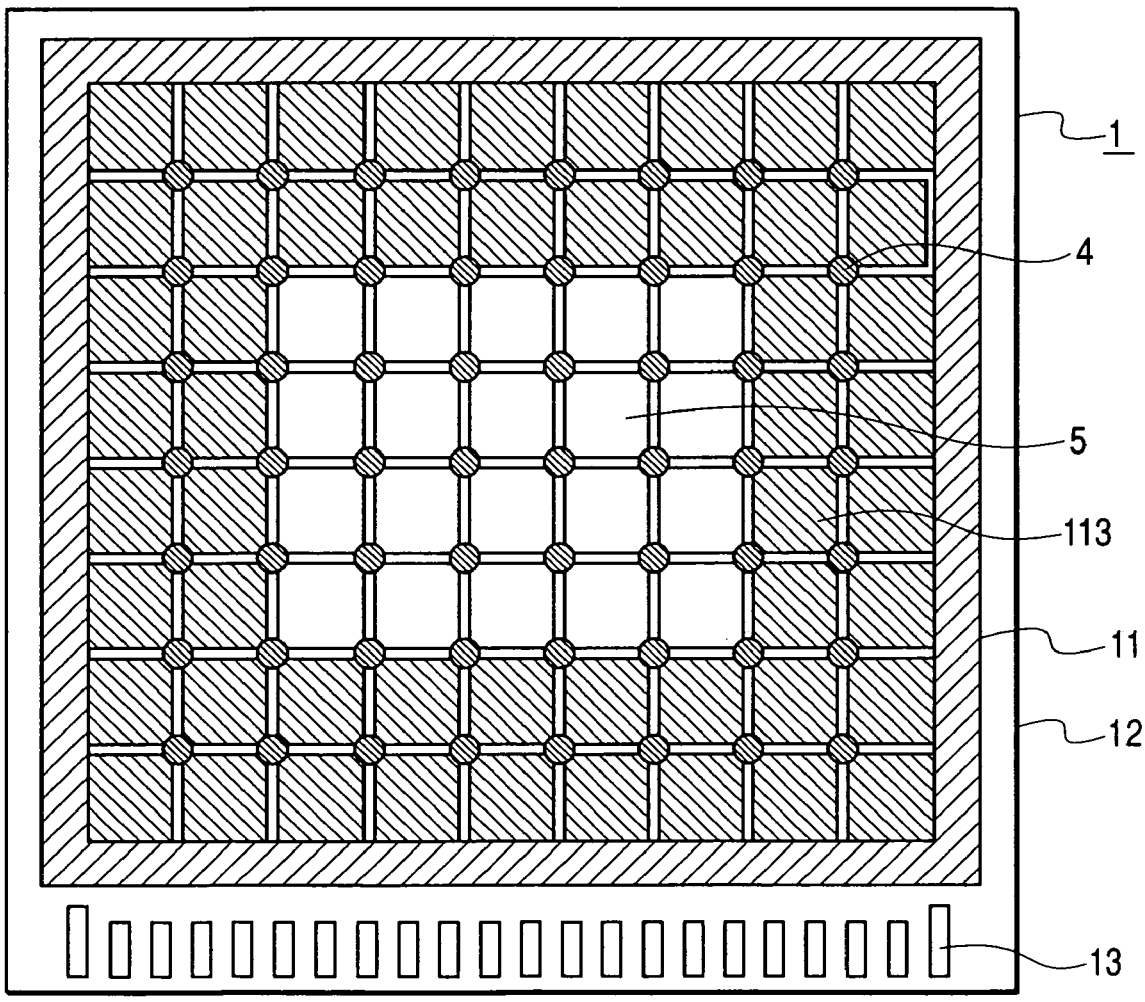
FIG. 16 is a schematic plan view showing a liquid crystal panel of the liquid crystal display device according to an embodiment of the present invention.

FIG. 16 is a schematic plan view illustrating a layout of the reflective electrode 5 and the spacers 4 provided on the drive-circuit substrate 1. A large number of spacers 4 are disposed over the entire surface of the drive-circuit substrate 1 in a matrix configuration to establish uniform spacing between the two substrates. The reflective electrode 5 is a minimum-size pixel of an image formed by the liquid crystal display element. For simplification in FIG. 16, the reflective electrodes 5 are illustrated as four pixels in a longitudinal direction and five pixels in a lateral direction.

In FIG. 16, the four pixels in the longitudinal direction and the five pixels in the lateral direction form a display area. An image displayed by the liquid crystal element is formed in this useful display area. Dummy pixels 113 are disposed outside of the useful display area. A peripheral frame 11 formed of the same material as the spacers 4 are provided at the periphery of the dummy pixels 113. Further, a sealing material 12 is coated outside of the peripheral frame 11. Reference numeral 13 are external connection terminals used for supplying signals from external equipment to the liquid crystal panel 100.

The spacers 4 and the peripheral frame 11 are formed of a resin material, examples of which include a negative photoresist of the chemically amplified type "BPR-113" (trade name) manufactured by JSR Corp. The photoresist material is applied by a spin coating method on the drive-circuit substrate 1 on which the reflective electrode 5 is formed, and then patterns of the spacers 4 and the peripheral frame 11 are exposed on the photoresist film through a mask. Thereafter, the photoresist is developed with a remover to form the spacers 4 and the peripheral frame 11.

When the spacers 4 and the peripheral frame 11 are formed from a photoresist material, etc., it is possible to control the height of the spacers 4 and the peripheral frame 11 by controlling the film thickness of a material to be applied, thus enabling formation of the spacers 4 and the peripheral frame 11 with a high precision. In addition, the positions of spacers 4 can be defined with a mask pattern, and it is possible to accurately position the spacers 4 at desired positions. The liquid crystal projector has a problem that the existence of the spacers 4 on pixels provides a visible shadow caused by the spacers on an enlarged projected image. By forming the spacers 4 through the exposure and the development by use of the mask pattern, the spacers 4 can be disposed at positions which cause no problem at the time of displaying an image.

In addition, since the peripheral frame 11 is formed simultaneously with forming the spacers 4, a method in which the liquid crystal composition 3 is first dropped onto the drive-circuit substrate 1 and then the transparent substrate 2 is bonded to the drive-circuit substrate 1 can be used as a method of sealing the liquid crystal composition 3 between the drive-circuit substrate 1 and the transparent substrate 2. During an operation of assembling the liquid crystal display panel, a problem arises in that a portion of the liquid crystal composition 3 leaks outward from the peripheral frame 11, and remains in regions to be filled with a sealing material 12. Consequently, an operation is needed which removes the liquid crystal composition 3 remaining in the regions to be filled with the sealing material 12.

Once the liquid crystal composition 3 has been contained between the drive-circuit substrate 1 and the transparent substrate 2, and the liquid crystal panel 100 has been assembled, the liquid crystal composition 3 can be retained within the area surrounded by the peripheral frame 11. Further, the sealing material 12 is applied outside of the peripheral frame 11, and the liquid crystal composition 3 is sealed with in the liquid crystal panel 100. As explained above, the peripheral frame 11 can be disposed on the drive-circuit substrate 1 with a high degree of positional accuracy since it is formed by using a mask pattern. This means the boundary of the liquid crystal composition 3 can be defined with a high degree of accuracy. In addition, the peripheral frame 11 can also define the boundary of the area of the sealing material 12 with a high degree of accuracy.

The sealing material 12 serves to fix the drive-circuit substrate 1 and the transparent substrate 2 together, and to prevent harmful substances from entering the liquid crystal composition 3. When a liquid sealing material 12 is used, the peripheral frame 11 functions as a stopper against the sealing material 12. Provision of the peripheral frame 11 as a stopper against the sealing material 12 can increase a design margin for the boundary of the liquid crystal composition 3 or the sealing material 12, thus making the distance from the edges of the liquid crystal panel 100 to the display area narrower (reduction in the perimeter area).

To orient the molecules of the liquid crystal composition 3 in a specified direction, orientation films will be coated on the two substrates, and the two substrates coated with the orientation films are rubbed with cloth or the like.

Since the peripheral frame 11 is formed to surround the display area, a problem arises in that the peripheral frame 11 interferes with rubbing of areas adjacent to the peripheral frame 11 when the drive-circuit substrate 1 is rubbed. In the present embodiment, the orientation film 7 is applied after the spacers 4 and the peripheral frame 11 are formed on the drive-circuit substrate 1. Thereafter, a process of rubbing the orientation film 7 with cloth, etc. is performed to orient the molecules of the liquid crystal composition 3 in a specified direction.

In the rubbing operation, since the peripheral frame 11 protrudes from the drive-circuit substrate 1, the orientation film 7 cannot be sufficiently rubbed at its portions closer to the peripheral frame 11 due to steps caused by the peripheral frame 11. Consequently, portions where the orientation of the liquid crystal molecules of the liquid crystal composition 3 are nonuniform are liable to appear in the vicinities of the peripheral frame 11. To make the nonuniformity in display caused by the defective orientation of the liquid crystal molecules of the liquid crystal composition 3 invisible, the dummy pixels 113 are provided instead of several regular pixels inside the peripheral frame 11, thus disabling them from contributing to a display.

However, when the dummy pixels 113 are provided and signals are supplied to them similarly to the pixels 5, a problem arises that images produced by the dummy pixels 113 is also observed since the liquid crystal composition 3 exists between the dummy pixels 113 and the transparent substrate 2. When the device is operated in the normally white mode, the dummy pixels 113 are displayed in white unless a voltage is applied across the layer of the liquid crystal composition 3. Consequently, boundaries of the display area become obscure, thus deteriorating the quality of the display. Of course, shielding the dummy pixels 113 from light is conceivable, but it is difficult to form a light-blocking frame with high precision at the boundaries of the display area since the gap between pixels is several micrometers. Consequently, a voltage is supplied to the dummy pixels 113 for them to provide a black image so that a black frame surrounding the display area is observed.

Figure 17:
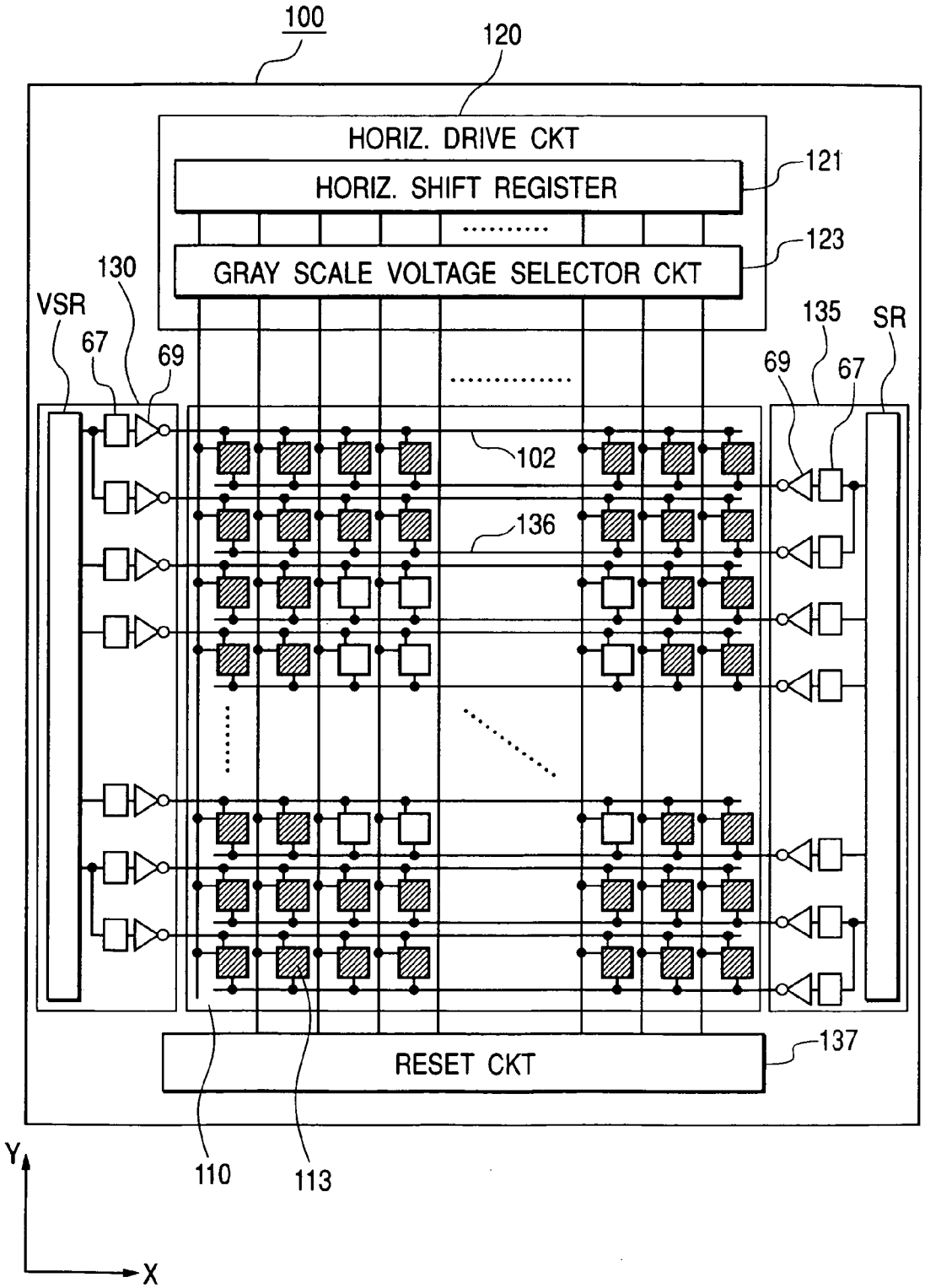
FIG. 17 is a schematic circuit diagram for explaining a method of driving dummy electrodes of the liquid crystal display device according to an embodiment of the present invention.

A method of driving the dummy pixels 113 will be described by referring to FIG. 17. Since a voltage which produces a black image is supplied to the dummy pixels 113, the area in which such dummy pixels are provided presents a black image over the entire area. If a black image is produced over the entire area, it is not necessary to form the dummy pixels independently from each other just like the regular pixels provided in the display area, and a plurality of electrically-connected dummy pixels can be disposed instead. In addition, in view of a time required for driving, it is of no use to allot time for writing into the dummy pixels. Therefore, it is possible to form a single dummy pixel by electrically connecting electrodes of plural dummy pixels.

However, forming a single dummy pixel by connecting the plural dummy pixels will result in an increased in area of the pixel electrode, and consequently, the liquid crystal capacitance becomes larger. As explained above, the efficiency of lowering the pixel voltage by using the pixel capacitance will be reduced as the liquid crystal capacitance becomes larger.

Therefore, the dummy pixels 113 also are formed separately from each other as in the case of with the pixels in the usable display area. However, if the dummy pixels are written into, line by line, as in the case of the usable pixels, time required for driving newly-provided plural rows of dummy pixels is increased. Consequently, a problem arises in that the time required for writing into usable pixels becomes shorter by that time required for the dummy pixel rows. In the case of a high definition display, much more restrictions on the time required for writing into pixels will arise since high-speed video signals (signals having higher dot clock frequencies) is input. Therefore, to save writing time corresponding to several rows during a writing period for one picture, as shown in FIG. 17, for dummy pixels, timing signals for a plurality of rows are output from a vertical bidirectional shift register VSR of the vertical drive circuit 130 to a plurality of level shifters 67 and the output circuits 69, thereby outputting scanning signals. Likewise, the bidirectional shift register SR of the pixel potential control circuit 135 is configured to output timing signals corresponding to a plurality of rows to a plurality of level shifters 67 and the output circuits 69, thereby outputting pixel potential control signals.

In the above explanation, plural rows of the dummy pixels 113 are written into simultaneously, but plural rows of the dummy pixels 113 can be written into, line by line successively. The display section 110 is illustrated as an area including the usable display area and the dummy pixels 113.

Figure 18:
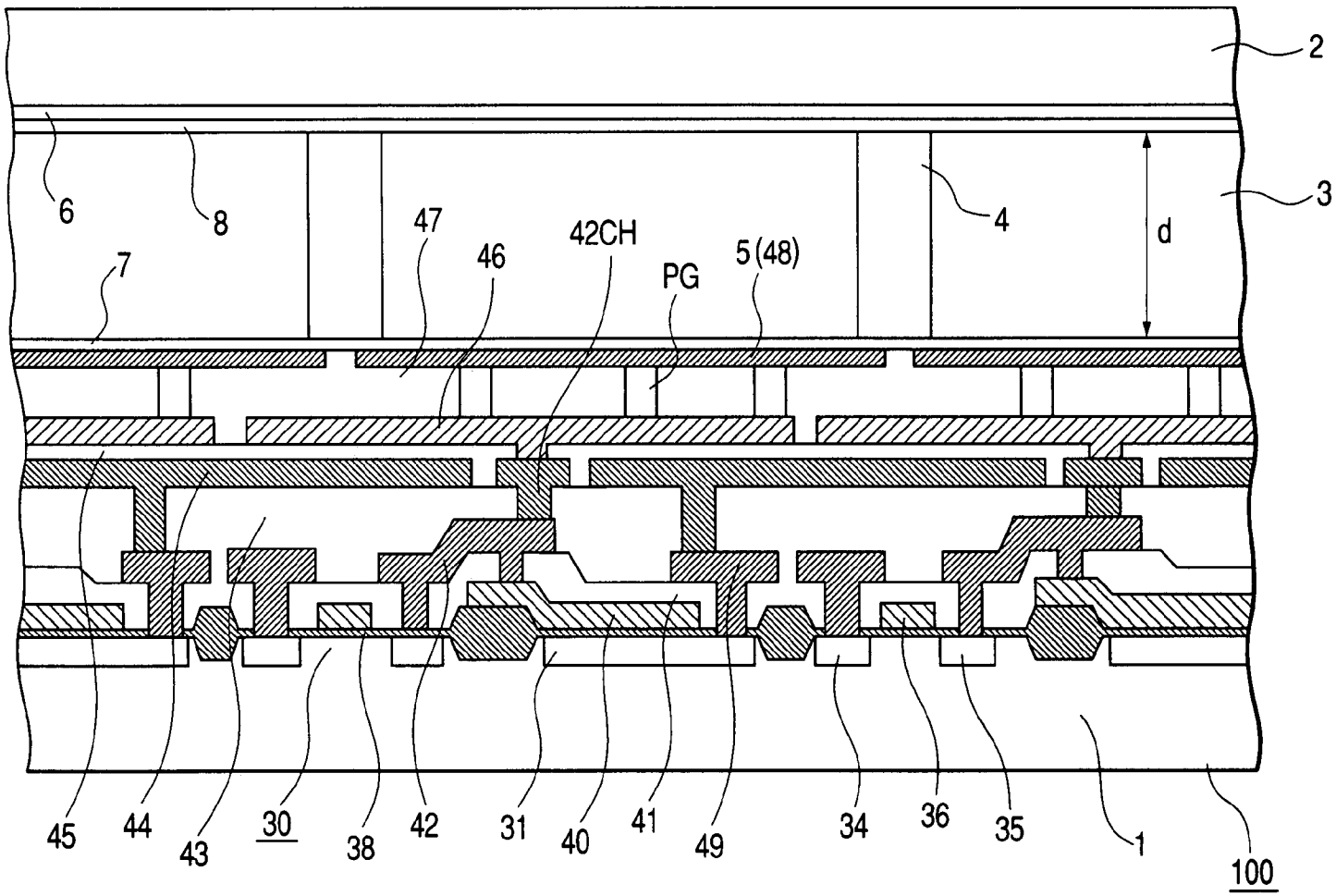
FIG. 18 is a schematic cross-sectional view of the liquid crystal display device according to an embodiment of the present invention.

A pixel of the reflective type liquid crystal display device LCOS according to the present invention will be described with reference to FIG. 8. FIG. 18 is a schematic sectional view of a liquid crystal panel used for an embodiment of the reflective type liquid crystal display device according to the present invention. In FIG. 18, reference numeral 100 is a liquid crystal panel, reference numeral 1 is a drive-circuit substrate which is referred to as a first substrate, reference numeral 2 is a transparent substrate which is referred to as a second substrate, reference numeral 3 is liquid crystal composition, and reference numeral 4 is a spacer. The spacers 4 establish a specified cell gap between the drive-circuit substrate 1 and the transparent substrate 2. The liquid crystal composition 3 is contained in the cell gap d. Reference numeral 5 is a reflective electrode (pixel electrode) formed on the drive-circuit substrate 1. Reference numeral 6 is a counter electrode for applying a voltage across the layer of the liquid crystal composition 3 between the counter electrode 6 and the reflective electrode 5. Reference numerals 7 and 8 are orientation films for orienting liquid crystal molecules in a specified direction. Reference numeral 30 is an active element, which supplies a gray scale voltage to the reflective electrode 5.

Reference numeral 34 is a source region of the active element 30, reference numeral 35 is a drain region of the active element 30, and reference numeral 36 is a gate electrode of the active element 30. Reference numeral 38 is an insulating film, reference numeral 31 is a first electrode forming a pixel capacitance, and reference numeral 40 is a second electrode forming the pixel capacitance. The first electrode 31 and the second electrode 40 provide capacitance with the insulating film 38 therebetween. In FIG. 18, the first electrode 31 and the second electrode 40 are represented as typical electrodes forming the pixel capacitance. Besides, another pixel capacitance can be formed if a conductive layer electrically connected to a pixel electrode and a conductive layer electrically coupled to a pixel-potential control signal line are disposed to each other with a dielectric layer sandwiched therebetween.

Reference numeral 41 is a first interlayer film, and reference numeral 42 is a first conductive film. The first conductive layer 42 electrically connects the drain region 35 to the second electrode 40. Reference numeral 43 is a second interlayer film, reference numeral 44 is a first light-blocking film, reference numeral 45 is a third interlayer film, and reference numeral 46 is a second light-blocking film. A through-hole 42CH is made in the second interlayer film 43 and the third interlayer film 45, and the first conductive film 42 and the second light-blocking film 46 are electrically connected. Reference numeral 47 is a fourth interlayer film, symbol PG denotes a plug, and reference numeral 48 is a second conductive film forming the reflective electrode 5. The second light-blocking film 46 and the second conductive film 48 are connected together by the plug PG. A gray scale voltage is transmitted from the drain region 35 of the active element 30 to the reflective electrode 5 via the first conductive film 42, the through-hole 42CH, the second light-blocking film 46, and the plug PG. Incidentally plural plugs PG may be provided for each of the pixels.

The liquid crystal display device of this embodiment is of the reflective type, and the liquid crystal panel 100 is illuminated with a large amount of light. The light-blocking film blocks light from entering the semiconductor layer of the drive-circuit substrate. In the reflective type liquid crystal display device, light incident on the liquid crystal panel 100 enters the transparent substrate 2 (at the top of FIG. 18), passes through the liquid crystal composition 3, is reflected on the reflective electrode 5, passes through the liquid crystal composition 3 and the transparent substrate 2 again, and exits from the liquid crystal panel 100. However, a portion of the light incident on the liquid crystal panel 100 will leak toward the drive-circuit substrate 1 through gaps between the adjacent reflective electrodes 5. The first light-blocking film 44 and the second light-blocking film 46 are provided to prevent light from entering the active element 30. In the present embodiment, the light-blocking films are made of conductive layers, the second light-blocking film 46 is electrically connected to the reflective electrode 5, and a pixel-potential control signal is supplied to the first light-blocking film 44 so that the light-blocking films serves to form part of the pixel capacitance.

In addition, by supplying the-pixel potential control signal to the first light-blocking layer 44, it is possible to use the first light-blocking film 44 as an electrical shield layer between the second light-blocking film 46 supplied with a gray scale voltage and the first conductive layer 42 forming the video signal line 103 or a conductive layer (a conductive layer formed in the same layer as the gate electrode 36) forming the scanning signal line 102. Consequently, the parasitic capacitance components decrease between the first conductive film 42 or the gate electrode 36, etc. and the second light-blocking film 46 or the reflective electrode 5. As described above, although it is necessary to select the pixel capacitance CC to be sufficiently larger compared with the liquid crystal capacitance CL, if the first light-blocking film 44 is used as an electrical shield layer, the parasitic capacitance connected in parallel with the liquid crystal capacitance CL is reduced, thus enhancing the efficiency. Further, with this arrangement, it is possible to reduce the introduction of noise from signal lines.

In addition, if a reflective type liquid crystal display elements is employed and its reflective electrode 5 is formed on the surface of the drive-circuit substrate 1 on its side facing the liquid crystal composition 3, it is possible to use an opaque silicon substrate, etc. as the drive-circuit substrate 1. Further, such arrangement provides advantages that it is possible to dispose the active element 30 or related wiring lines below the reflective electrode 5, thus increasing an area of the reflective electrode 5 which will act as a pixel and thereby realizing a high aperture ratio. Furthermore, the arrangement offers another advantage that heat generated by light incident on the liquid crystal panel 100 can be radiated from the back of the drive-circuit substrate 1.

Figure 19:
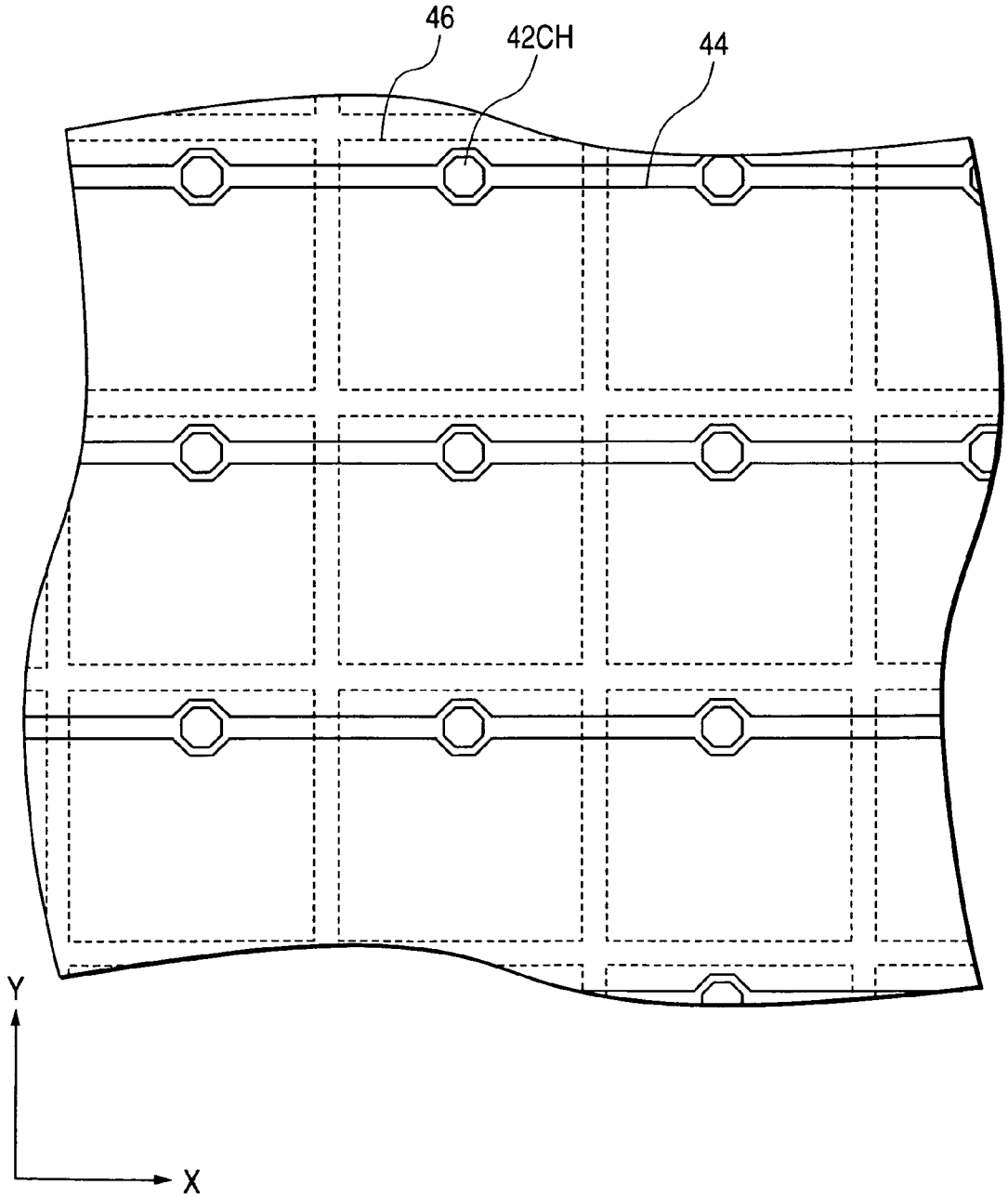
FIG. 19 is a schematic plan view showing a configuration which forms a pixel potential control line by using a light-blocking film of the liquid crystal display device according to an embodiment of the present invention.

The following explains the use of the light-blocking film for forming part of the pixel capacitance. The first light-blocking film 44 and the second light-blocking film 46 face each other with the third interlayer film 45 therebetween, thus forming part of the pixel capacitance. Reference numeral 49 is a conductive layer forming part of the pixel-potential control line 136. The first electrode 31 is electrically connected to the first light-blocking film 44 via the conductive layer 49. In addition, it is possible to form a wiring line from the pixel-potential control circuit 135 to the pixel capacitance by using the conductive layer 49. However, in this embodiment, the first light-blocking film 44 is used as the wiring line. FIG. 19 illustrates a configuration wherein the first light-blocking film 44 is used as the pixel-potential control line 136.

FIG. 19 is a plan view showing the arrangement of the light-blocking films 44. Reference numeral 46 are the second light-blocking films indicated by dotted lines to indicate their positions. Reference numeral 42CH is a through-hole for connecting the first conductive film 42 and the second light-blocking film 46 together. It should be noted that, in FIG. 19, other components are omitted to facilitate understanding of the first light-blocking film 44. The first light-blocking film 44 has a function of the pixel potential control line 136 and extends continuously in the X direction shown in FIG. 19. The first light-blocking films 44 are formed in a manner to cover the entire display area since they function as light-blocking films, and they also extends in the form of strip electrodes in the X direction (in a direction parallel with the scanning signal lines 102) to serve as the pixel potential control lines 136, and are arranged in the Y direction, and are coupled to the pixel-potential control circuit 135. Further, since the first light-blocking films 44 function as electrodes of the pixel capacitance, it is formed in such a manner as to overlap with the second light-blocking film 46 in areas as large as possible. Further, gaps between adjacent first light-blocking films 44 are formed as narrowly as possible so that the first light-blocking films 44 function as light-blocking films to reduce the leakage of light.

Figure 20:
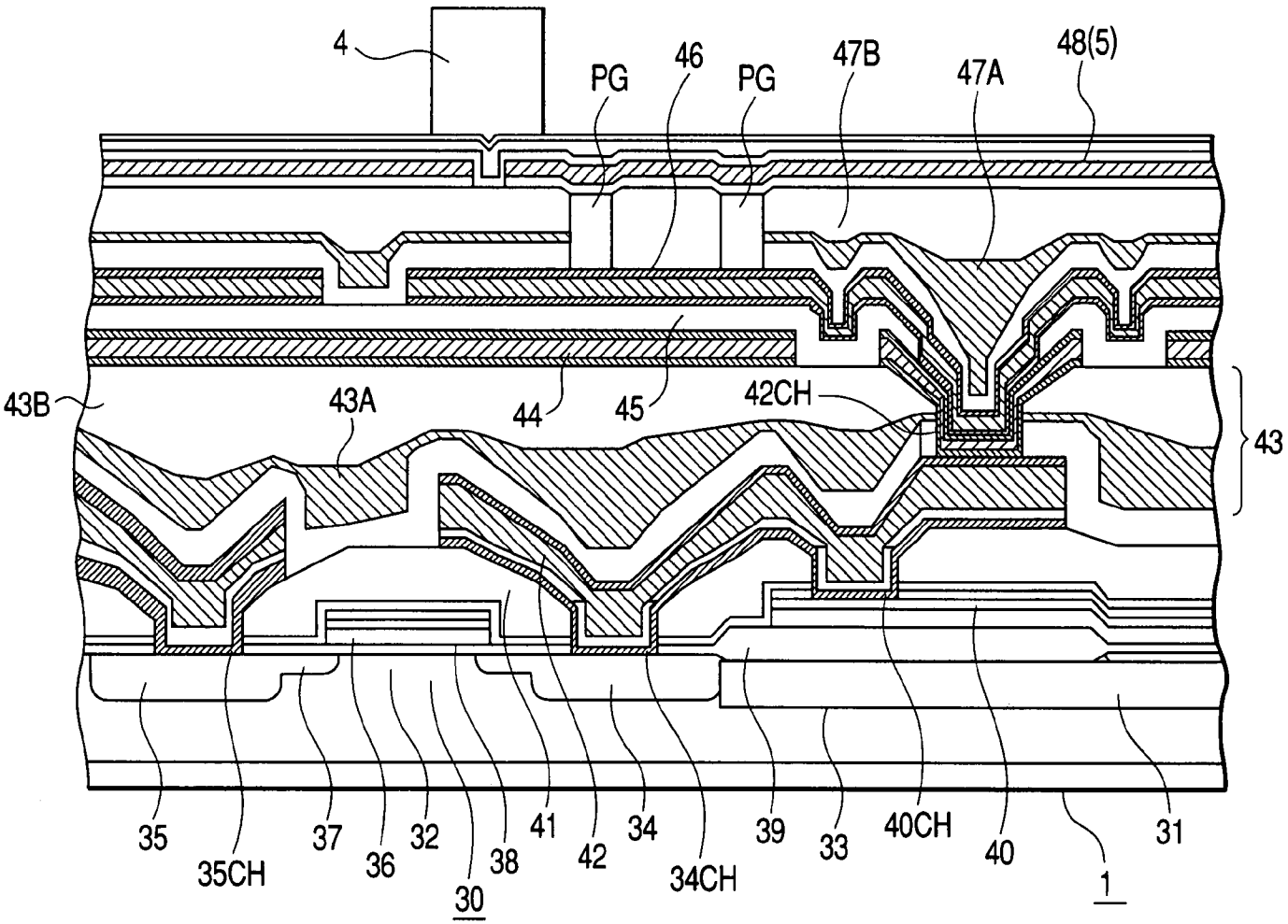
FIG. 20 is a schematic cross-sectional view of an active element and its vicinity in the liquid crystal display device in accordance with an embodiment of the present invention.
Figure 21:
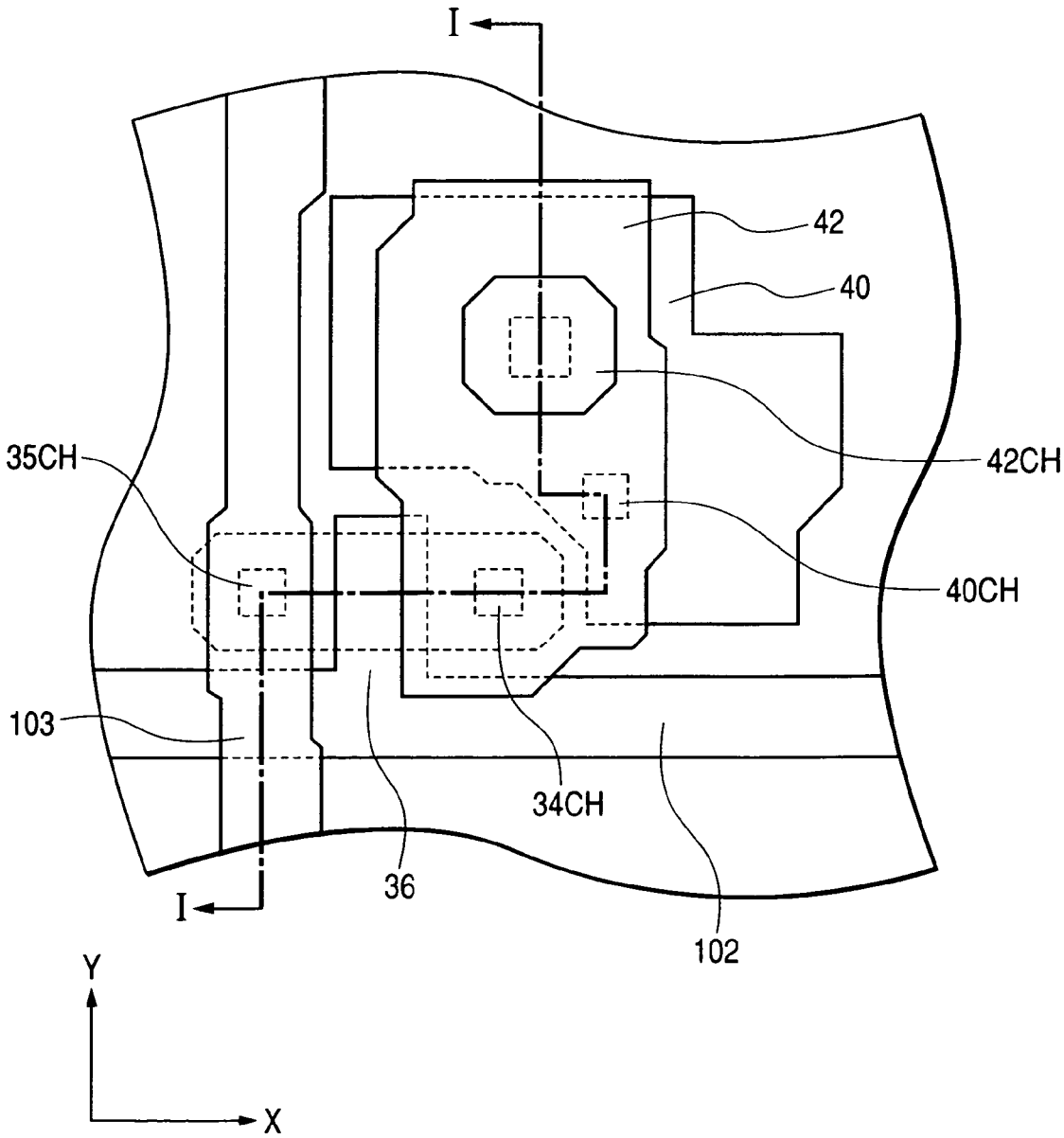
FIG. 21 is a schematic plan view of an active element and its vicinity in the liquid crystal display device in accordance with an embodiment of the present invention.
Figure 22:
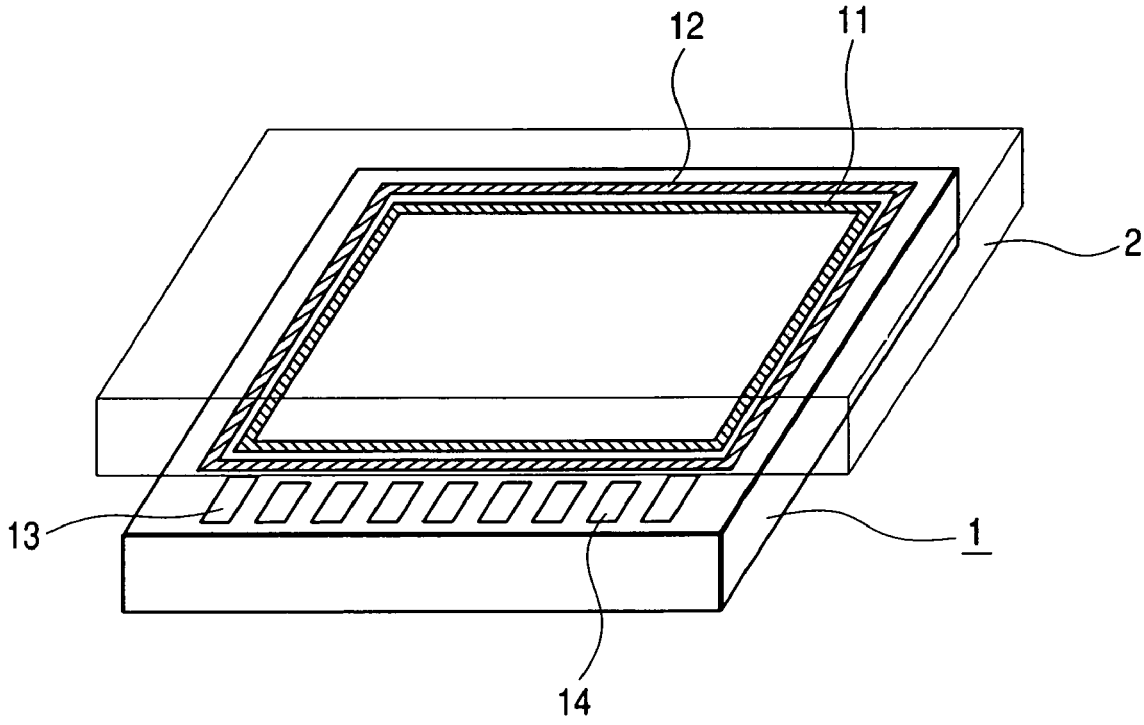
FIG. 22 is a schematic perspective view of the liquid crystal display device in accordance with an embodiment of the present invention.

The active element 30 and its adjacent structures disposed on the drive-circuit substrate 1 will be described in detail by referring to FIGS. 20 and 21. It should be noted that, in FIGS. 20 and 21, the same reference numerals as those in FIG. 18 indicate the same structures. FIG. 22 is a schematic plan view showing the active element 30 and its vicinity. FIG. 20 is a cross-sectional view taken along line I-I of FIG. 21, but the dimensions between FIGS. 20 and 21 are not consistent. FIG. 21 only illustrates the respective positional relationships between the scanning signal line 102, the gate electrode 36, the video signal line 103 and the source region 35, the drain region 34, the second electrode 40 which forms the pixel capacitance, the first conductive layer 42, and the contact holes 35CH, 34CH, 40CH, 42CH, and other structures are omitted.

In FIG. 20, reference numeral 1 is a silicon substrate which is a drive-circuit substrate, reference numeral 32 is a semiconductor region (p-well) fabricated within the silicon substrate 1 by using ion implantation, reference 33 is a channel stopper, reference numeral 34 is a drain region fabricated within the p-well 32 by being made conductive by using ion implantation, reference numeral 35 is a source region fabricated within the p-well 32 by using ion implantation, and reference 31 is a first electrode of the pixel capacitance fabricated within the p-well 32 by being made conductive by using ion implantation. It should be noted that, although the active element 30 is represented by ap-type transistor in the present embodiment, an n-type transistor can also be employed instead.

Reference numeral 36 is a gate electrode, reference numeral 37 is an offset region which relaxes the electric field strength at the ends of the gate electrode, reference numeral 38 is an insulating film, reference numeral 39 is a field oxide layer for electrically isolating transistors from each other, and reference numeral 40 is a second electrode forming pixel capacitance in cooperation with the first electrode 31 disposed on the silicon substrate 1 with the insulating film 38 therebetween. Each of the gate electrode 36 and the second electrode 40 is composed of two films stacked on the insulating film 38, one of the stacked films is a conductive layer for lowering the threshold of the active element 30, and the other of the stacked films is a conductive layer of low resistance. The two stacked films can be made of a polysilicon film and a tungsten silicide film, for example. Reference numeral 41 is a first interlayer film, and reference numeral 42 is a first conductive film. The first conductive film 42 is a multilayer film composed of a barrier metal for preventing defective contacts and a conductive film of low resistance. For example, a multilayer film composed of a sputtered titanium tungsten film and a sputtered aluminum film may be used as the first conductive film.

In FIG. 21, reference numeral 102 is a scanning signal line. The scanning signal lines 102 (only one of which is shown) extend in the X direction and are arranged in the Y direction in FIG. 21, and they are supplied with a scanning signal for turning on or off the active element 30. The scanning signal lines 102 are composed of the same two-layered film as that of the gate electrodes, and, for example, the two-layered films can be formed of two stacked layers of a polysilicon layer and a tungsten silicide layer. The video signal lines 103 extend in the Y direction and are arranged in the X direction, and they are supplied with video signals to be written into the reflective electrodes 5. The video signal lines 103 are formed of the same multilayer metallic films as those of the first conductive films 42, and, for example, they can be formed of a titanium tungsten film and a aluminum film which are stacked one on another.

A video signal is transmitted to the drain region 35 (see FIG. 20) by the first conductive film 42 via the contact hole 35 made in the insulating film 38 and the first interlayer film 41. When a scanning signal is supplied to the scanning signal line 102, the active element 30 is turned on, the video signal is transmitted to the source region 34 from the semiconductor region (p-well) 32, and then is transmitted to the first conductive film 42 via the contact hole 34CH. The video signal transmitted to the first conductive film 42 is then transmitted to the second electrode 40 of the pixel capacitance via the contact hole 40CH.

Further, as shown in FIG. 20, the video signal is transmitted to the reflective electrode 5 through the contact hole 42CH. The contact hole 42CH is disposed above the field oxide layer 39. The field oxide layer 39 has a large film thickness, and therefore, structures placed above the field oxide layer are at positions higher than other structures. The contact hole 42CH is above the field oxide layer 39, and therefore, it can be located at a position closer to the upper conductive upper layer, thus making a length of the connection section of the contact hole shorter.

Further, as shown in FIG. 20, the second interlayer film 43 insulates the first conductive film 42 from the second conductive film 44. The second conductive film 43 is formed of two layers, a planarizing film 43A for covering and smoothing unevenness caused by structures and an insulating film 43B for covering the planarizing film 43A. The planarizing film 43A is fabricated by coating SOG (spin on glass) material on it. The insulating film 43B is a TEOS film which is obtained by forming an $SiO_2$ film by the CVD (Chemical Vapor Deposition), using TEOS (Tetraethylorthosilicate) as a reaction gas.

After forming the second interlayer film 43, the second interlayer film 43 is polished by CMP (Chemical Mechanical Polishing). The second interlayer film 43 can be smoothened by the CMP process. The first light-blocking film 44 is formed on the smoothed second interlayer film 43. The first light-blocking film 44 is formed of the same multilayer metallic film composed of tungsten and aluminum layers as the first conductive film 42.

The first light-blocking film 44 covers the nearly entire area of the drive-circuit substrate 1, and an opening in the first light-blocking film 44 is only the contact hole 42CH. The third interlayer film 45 made of the TEOS film is formed on the first light-blocking film 44. Further, the second light-blocking film 46 is formed on the third interlayer film 45. The second light-blocking film 46 is formed of the same multilayer metallic film composed of tungsten and aluminum layers as the first conductive film 42. The second light-blocking film 46 is coupled to the first conductive film 42 via the contact hole 42CH. A metallic film forming the first light-blocking film 44 and a metallic film forming the second light-blocking film 46 are stacked in the contact hole 42CH 44 for electrically connecting the first light-blocking film 44 and the metallic film forming the second light-blocking film 46 together.

The first light-blocking film 44 and the second light-blocking film 46 are made of conductive films, and the third interlayer film 45 formed of an insulating film (dielectric film) is disposed between the first and the second light-blocking films 44, 46. A pixel-potential control signal is supplied to the first light-blocking film 44 and a gray scale voltage is supplied to the second light-blocking film 46, and a pixel capacitance can be formed between the first light-blocking film 44 and the second light-blocking film 46. Considering the with stand voltage of the third interlayer film 45 against gray scale voltages and increasing of capacitance by reducing a film thickness, the preferable film thickness of the third interlayer film 45 is in a range of from 150 nm to 450 nm, and especially approximately 300 nm.

The second light-blocking film 46 and the second conductive film 48 are electrically connected by the plug PG. The plug PG is formed by fill a through-hole made in the fourth interlayer film 47 with tungsten or the like. Therefore unevenness of a film (the reflective electrode 5) overlying the plug PG is reduced compared with the film overlying the contact hole CH, and the film overlying the plug PG is smoother. Since the unevenness of the reflective electrode 5 reduces light reflectance of the liquid crystal display panel 100, conventionally, only one contact hole has been provided in each of the pixels for electrically connecting the reflective electrode 5 (the second conductive film 48) and a layer underlying it, but in this embodiment, the reflective electrode 5 overlying the plug PG is relatively flat, plural plugs PG can be provided in each of the pixels.

FIG. 22 s a perspective view of the drive circuit substrate 1 superposed with the transparent substrate 2. The peripheral frame 11 is formed at the periphery of the drive circuit substrate 1, and the liquid crystal composition 3 is confined in a space surrounded by the peripheral frame 11, the drive circuit substrate 1 and the transparent substrate 2. The sealing member 12 is coated around the outside of the peripheral frame 11 between the superposed drive circuit substrate 1 and transparent substrate 2. The drive circuit substrate 1 and the transparent substrate 2 are fixed together by the sealing member 12 to form the liquid crystal display panel 100. Reference numeral 13 denote external connection terminals.

Figure 23A:
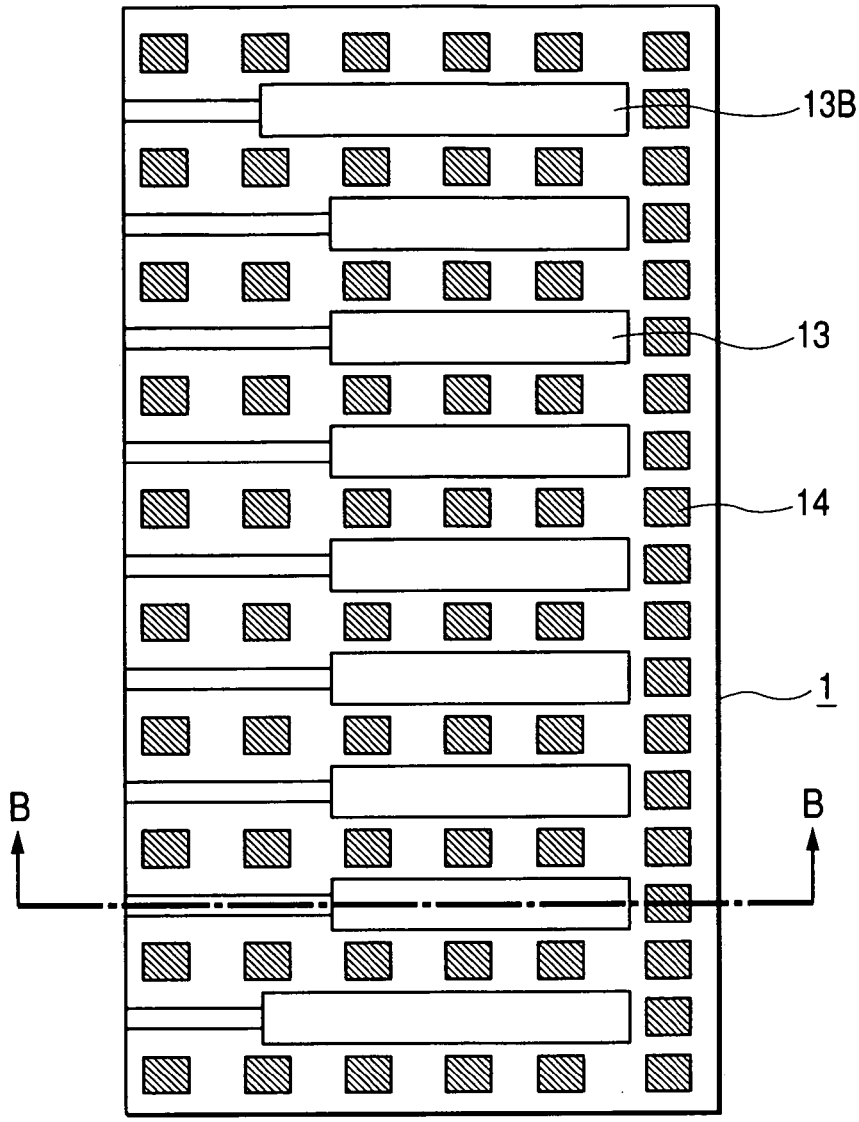
FIG. 23A is a schematic plan view of external terminals and their vicinities for explaining an embodiment of the display device in accordance with the present invention.
Figure 23B:
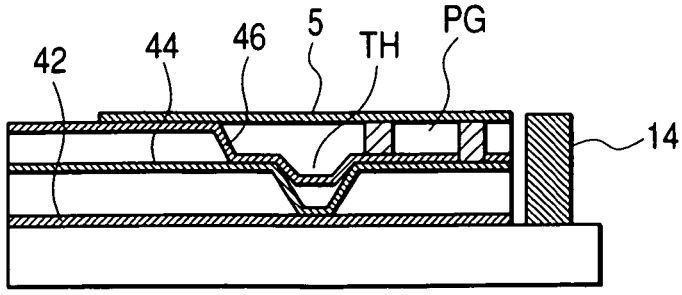
FIG. 23B is a cross-sectional view of the display device taken along line B-B of FIG. 23A.

FIGS. 23A and 23B are enlarged schematic views of the external connection terminals 13, FIG. 23A is a plan view of the external connection terminals 13, and FIG. 23B is a cross-sectional view of the external connection terminals 13 taken along line B-B of FIG. 23A. In FIG. 13A, reference numeral 13B denotes an external connection terminal made longer than the others for facilitating positioning in connecting operation. Reference numeral 14 denote dummy patterns disposed in the vicinities of the external connection terminals 13. Structures other than the external connection terminals 13 are not provided between adjacent ones of the external connection terminals 13 on the drive-circuit substrate 1 for preventing occurrence of short-circuit when the external connection terminals are connected to external equipment. Consequently, the density of patterns is coarser than that in the other areas of the drive-circuit substrate 1. Provision of the dummy patterns in the vicinities of the external connection terminals 13 makes the density of patterns uniform and makes it possible to polish thin films uniformly. A conductive film constituting the external connection terminals 13 is formed by stacking the first conductive film 42, the first light-blocking film 44, the second light-blocking film 46, and the reflective electrode 5, as shown in FIG. 23B. The second light-blocking film 46 and the reflective electrode 5 are electrically connected together in the connection point by using the plug PG. Employment of the plug PG makes it possible to fabricate relatively flat external connection terminals 13.

Figure 24:
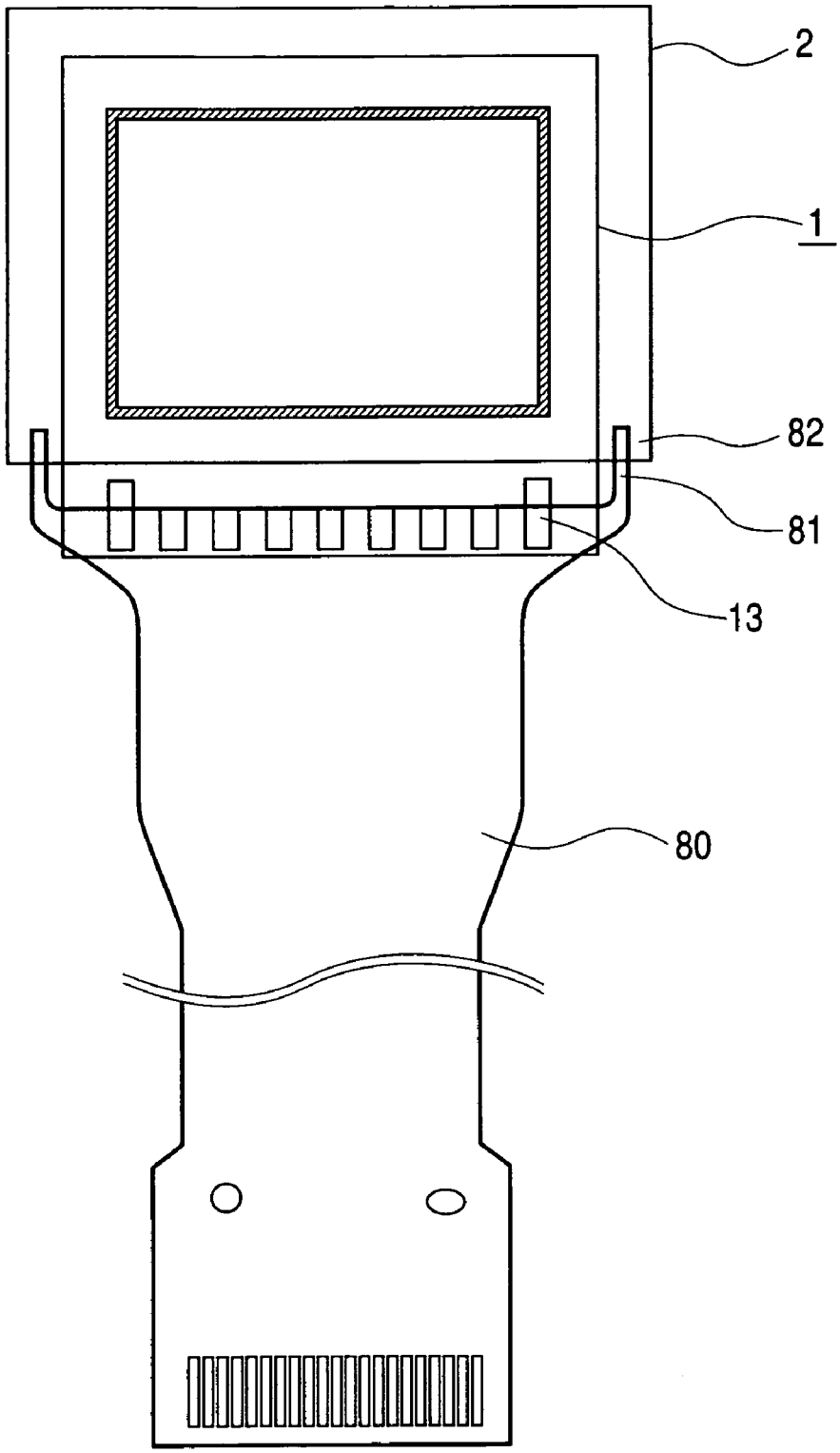
FIG. 24 is a schematic plan view of a liquid crystal display panel having a flexible printed circuit board coupled thereto in the liquid crystal display device in accordance with an embodiment of the present invention.

As shown in FIG. 24, a flexible printed wiring board 80 for supplying external signals to the liquid crystal display panel 100 is connected to the external connection terminals 13. Two outermost terminals on opposite sides of one end of the flexible printed wiring board 80 are made longer than the remainder of terminals, are connected to the counter electrode 5 formed on the transparent substrate 2, and thereby serve as counter-electrode terminals 81. In this way, the flexible printed wiring board 80 is connected to both the drive circuit substrate 1 and the transparent substrate 2.

Conventionally, a flexible printed wiring board is connected to external connection terminals disposed on the drive-circuit substrate 1 only, and therefore the wiring to the counter electrode 5 from the flexible printed wiring board is made via the drive-circuit substrate 1.

The transparent substrate 2 in this embodiment of the present invention is provided with connecting portions 82 to be connected to the flexible printed wiring board 80 such that the flexible printed wiring board 80 is connected directly to the counter electrode 5. The liquid crystal display panel 100 is formed by superposing the transparent substrate 2 on the drive circuit substrate 1, and the transparent substrate 2 is superposed on the drive circuit substrate 1 such that a peripheral portion of the transparent substrate 2 extends beyond the outside edges of the drive circuit substrate 1 and provides the connecting portions 82 to be connected to the flexible printed wiring board 80.

Figure 25:
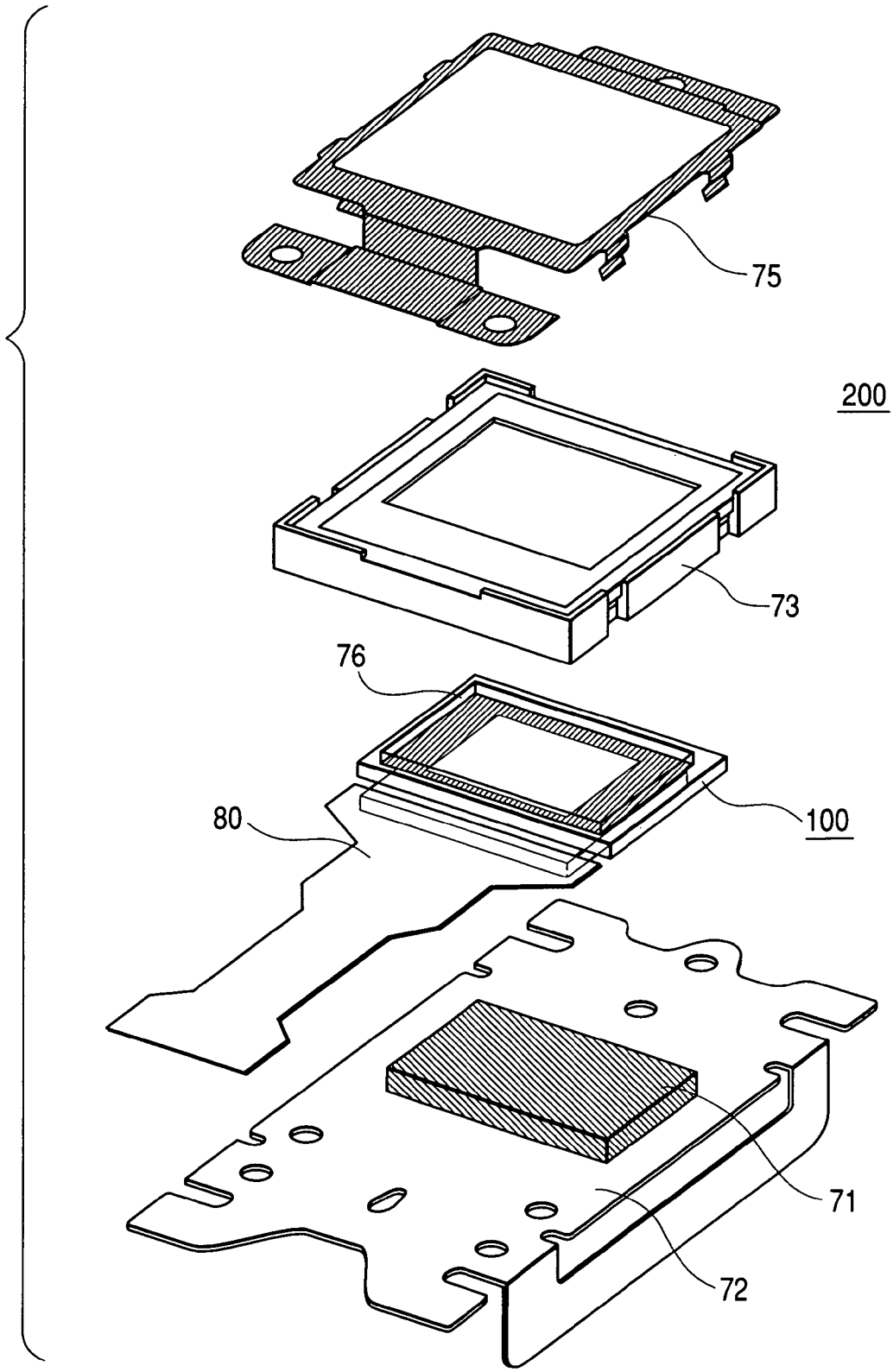
FIG. 25 is a schematic exploded view in perspective of the liquid crystal display device in accordance with an embodiment of the present invention.
Figure 26:
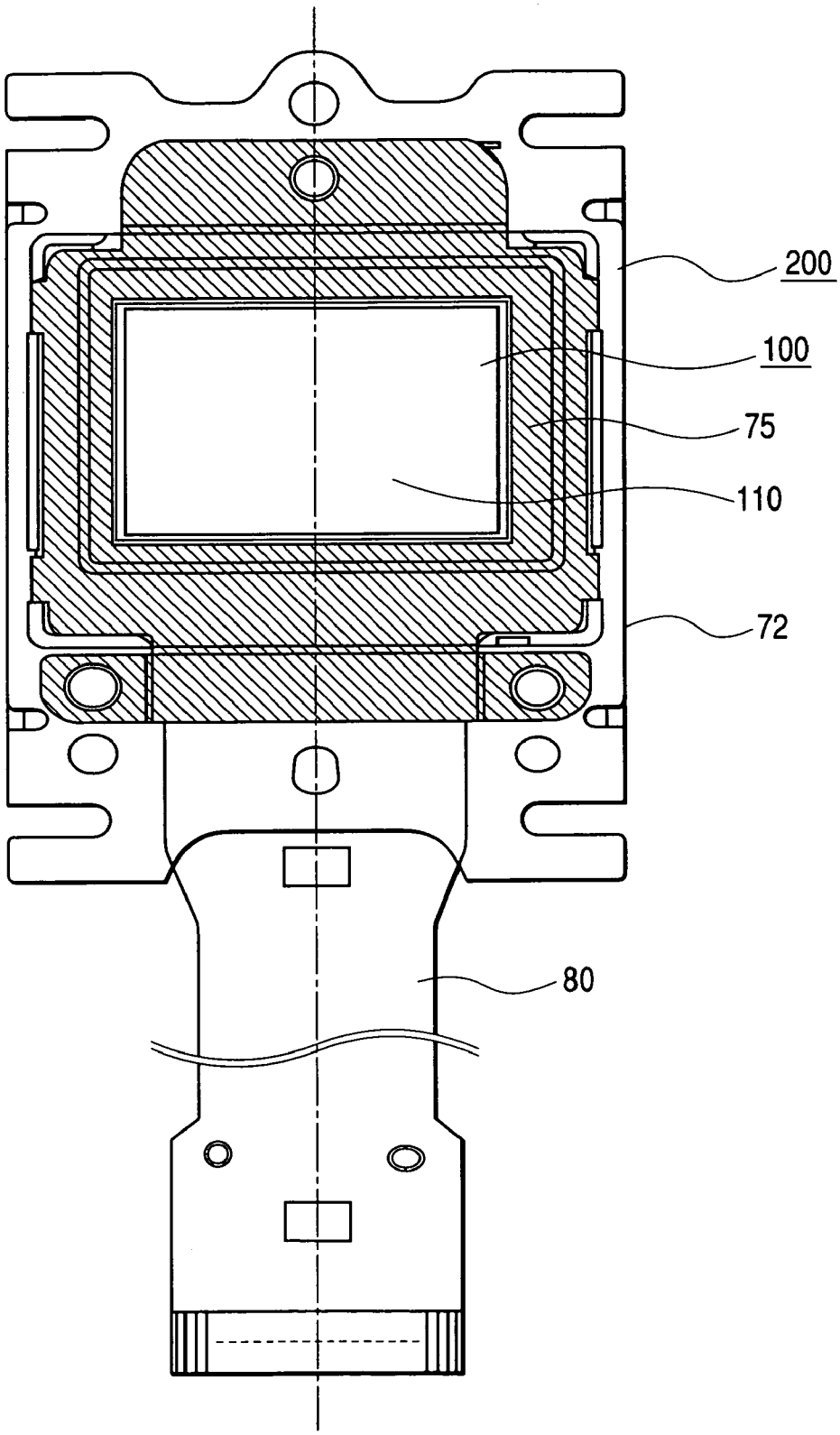
FIG. 26 is a schematic plan view of the liquid crystal display device in accordance with an embodiment of the present invention.

FIGS. 25 and 26 illustrate a configuration of the liquid crystal display device 200. FIG. 25 is an exploded view in perspective of the major elements of the liquid crystal display device 200, and FIG. 26 is a plan view of the liquid crystal display device 200.

As shown in FIG. 25, the liquid crystal display panel 100 having the flexible printed wiring board 80 connected thereto is disposed on the heat-radiating plate 72 with a heat sink compound 71 interposed therebetween. The heat sink compound 71 is highly heat-conductive, and fills a gap between the heat-radiating plate 72 and the liquid crystal display panel 100 for heat from the liquid crystal display panel 100 to conduct to the heat-radiating plate 72 easily. Reference numeral 73 denotes a mold which is fixed to the heat-radiating plate 72 with an adhesive.

As shown in FIG. 25, the flexible printed wiring board 80 is passed between the mold 73 and the heat-radiating plate 72, and then is brought out of the mold 73. Reference numeral 75 denotes a light-blocking plate which prevents light from a light source from entering the unintended portions of the liquid crystal display device 200. Reference numeral 76 denotes a light-blocking frame which defines the display area of the liquid crystal display device 200.

The invention by the present inventors has been explained concretely based upon the embodiments in accordance with the present invention, but the present invention is not limited to the above-described embodiments, and various changes and modifications can be made without departing from the spirit and scope of the present invention.

The advantages obtained by the representative ones of the inventions disclosed in this specification can be summarized as follows:

The present invention realizes reflective type liquid crystal display devices capable of reducing the size of drive circuits of the digital-to-analog conversion type, and suppressing variations in gray scale voltages to be supplied to the drive circuits.

What is claimed is:

1. A liquid crystal display device comprising:

a liquid crystal display panel including a first substrate, a second substrate, a liquid crystal composition sandwiched between said first substrate and said second substrate, a plurality of pixels arranged in a matrix configuration on said first substrate, a plurality of video signal lines for supplying video signal voltages to said plurality of pixels; and a drive circuit for supplying video signal voltages to said plurality of video signal lines;

wherein said drive circuit includes a selector circuit which receives display data signals, a gray scale voltage varying with time periodically, and time control signals varying in synchronism with said gray scale voltage, and selects an intended voltage level of said gray scale voltage by determining a timing corresponding to said intended voltage level of said gray scale voltage based upon said display data signals and said time control signals;

wherein said selector circuit has a plurality of display data signal lines coupled thereto for receiving said display data signals, and is comprised of a plurality of series combinations of a plurality of processing circuits each disposed between two adjacent ones of said plurality of display data signal lines, and each of said plurality of processing circuits is comprised of a parallel combination of a display data switching element and a time signal switching element, with a control terminal of said display data switching element being supplied with a corresponding one of said display data signals, and with a control terminal of said time signal switching element being supplied with a corresponding one of said time control signals; and wherein a stabilizer circuit is provided to a gray scale voltage line for supplying said gray scale voltage such that a change in voltage or current is suppressed under varying loads on said gray scale voltage line.

2. A liquid crystal display device according to claim 1, wherein said display data switching element is formed of a transistor of a same conductivity type as that of a transistor forming said time signal switching element.

3. A video signal line drive circuit having a selector circuit which selects and outputs a voltage level of a gray scale voltage varying with time periodically in accordance with display data signals supplied to said selector circuit;

wherein said selector circuit has a plurality of display data signal lines coupled thereto for receiving said display data signals and a plurality of video signal lines coupled thereto for outputting said voltage levels, and is comprised of a plurality of series combinations of a plurality of processing circuits each disposed between two adjacent ones of said plurality of display data signal lines;

wherein each of said plurality of processing circuits is comprised of a parallel combination of a display data switching element and a time signal switching element, with a control terminal of said display data switching element being supplied with a corresponding one of said display data signals, and with a control terminal of said time signal switching element being supplied with a corresponding one of said time control signals varying in synchronism with said gray scale voltage;

wherein said selector circuit selects an intended voltage level of said gray scale voltage by determining a timing corresponding to said intended voltage level of said gray scale voltage based upon said display data signal and said time control signals, and outputs said intended voltage level to a corresponding one of said plurality of video signal lines; and wherein a stabilizer circuit is provided to a gray scale voltage line for supplying said gray scale voltage.

* * * * *